US009360228B2

(12) United States Patent
Branham et al.

(10) Patent No.: US 9,360,228 B2
(45) Date of Patent: Jun. 7, 2016

(54) VENTILATION CONTROL SYSTEM AND METHOD

(75) Inventors: Tony Branham, Gig Harbor, WA (US); Christopher Erickson, Gig Harbor, WA (US)

(73) Assignee: GTR Technologies, Inc., Gig Harbor, WA (US)

( * ) Notice: Subject to any disclaimer, the term of this patent is extended or adjusted under 35 U.S.C. 154(b) by 999 days.

(21) Appl. No.: 13/522,112

(22) PCT Filed: Jan. 13, 2011

(86) PCT No.: PCT/US2011/021218

§ 371 (c)(1),
(2), (4) Date: Oct. 8, 2012

(87) PCT Pub. No.: WO2011/088270

PCT Pub. Date: Jul. 21, 2011

(65) Prior Publication Data

US 2013/0020397 A1 Jan. 24, 2013

Related U.S. Application Data

(60) Provisional application No. 61/294,696, filed on Jan. 13, 2010, provisional application No. 61/351,073, filed on Jun. 3, 2010.

(51) Int. Cl.

| | |
|---|---|
| ***F24F 3/14*** | (2006.01) |
| ***F24F 7/00*** | (2006.01) |
| ***E03B 1/00*** | (2006.01) |
| ***F24F 11/00*** | (2006.01) |

(52) U.S. Cl.
CPC ..... *F24F 11/0001* (2013.01); *F24F 11/0012* (2013.01); *F24F 11/0015* (2013.01); *F24F 2011/0064* (2013.01); *Y10T 137/0324* (2015.04)

(58) Field of Classification Search
CPC ..... F24F 11/0001; F24F 11/0012; F24F 11/0015; F24F 2011/0064
USPC ..... 236/44 A, 49.3; 137/2
See application file for complete search history.

(56) References Cited

U.S. PATENT DOCUMENTS

| | | | | | |
|---|---|---|---|---|---|
| 5,058,388 | A * | 10/1991 | Shaw | F24F 3/044 | 62/176.6 |
| 5,622,057 | A * | 4/1997 | Bussjager | F24F 3/153 | 62/173 |
| 5,873,256 | A * | 2/1999 | Denniston | B60H 1/00414 | 62/244 |
| 6,202,429 | B1 * | 3/2001 | Kinkel | F24F 1/022 | 165/225 |

(Continued)

FOREIGN PATENT DOCUMENTS

| | | |
|---|---|---|
| CA | 2 625 198 A1 | 5/2007 |
| CA | 2 558 994 A1 | 3/2008 |

(Continued)

*Primary Examiner* — Henry Crenshaw
(74) *Attorney, Agent, or Firm* — Seed IP Law Group PLLC

(57) ABSTRACT

A system and method of controlling a ventilation system is provided based on a determination of local dew point and automatically activating an exhaust fan before condensate appears on structure and objects and ideally before visible condensation forms in the air of an enclosed area. Firmware in the control circuit detects the presence of hardware components and operates a control circuit in one of a plurality of modes based on the detected hardware components that are coupled to the control circuit.

10 Claims, 35 Drawing Sheets

(56) References Cited

U.S. PATENT DOCUMENTS

| | | | | |
|---|---|---|---|---|
| 6,625,995 | B2 | 9/2003 | Remond et al. | |
| 8,034,491 | B2 | 10/2011 | Ryu et al. | |
| 2001/0032470 | A1* | 10/2001 | Remond | B60H 1/00785 62/133 |
| 2002/0011923 | A1* | 1/2002 | Cunningham | H04L 12/2803 340/12.32 |
| 2007/0177857 | A1* | 8/2007 | Troost | F24H 9/20 392/345 |
| 2007/0205294 | A1* | 9/2007 | Byczynski | F24F 11/0001 236/44 C |
| 2008/0029611 | A1* | 2/2008 | Schnell | F24F 11/0008 236/44 C |
| 2009/0039170 | A1* | 2/2009 | Burns | B60H 1/00785 236/44 A |

FOREIGN PATENT DOCUMENTS

| | | | |
|---|---|---|---|
| CN | 101196333 | A | 6/2008 |
| GB | 2 210 966 | A | 6/1989 |
| GB | 2 400 457 | A | 10/2004 |
| JP | 63-307509 | A | 12/1988 |
| JP | H08-94234 | * | 4/1996 |
| JP | 2001-500291 | A | 1/2001 |

* cited by examiner

```
; AU01-102
;*************************************************************
; Reset_Int     Put input buttons on weak pull-up
;*************************************************************
Reset_Int:
; Global interrupt disable
; Clear Zero register
;*************************************************************
;  0  0   1  0,  0    1    0   1
;  - Tmp Sw3 -, Sns3 Sns2 LED Sw12
;  0  0   0  0,  0    0    0   0
;  i  i   i  i,  i    i    i   i

; 0 0 0 0, 0  0   0  0
; - - - -, - Sam Fa La
; 0 0 0 0, 0  0   1  1
; i i i i, i  i   o  o

; Watchdog is 2048 cyc's And enabled

; Put the stack at the end of RAM

; Disable analog comparator

; Disable Ext Int
; Enable sleep mode in Idle.

; Ensure self program is disabled
; Start EE Read of 0x00
; Enable T0 INT
; Start timer slow 260µ
; 2s settling loop
; Bring in stored commands
; Is sensor to be used ?
; Yes, set command bit
; Is the lamp relay present ?
; Yes, say so
; Start timer for 8µs clock

; Look for third button
; A2D enabled, single conversion, /32
; Left justified
; Is there a third button ?
; No, continue
; Yes, say so
; Load case count
; Load level
```

FIG. 6A

```
; Begin the begin
;*************************************************************
; Los Entry
; Bit 2 high ?
; Yes, do case 4
; No. Bit 1 high ?
;   Yes, look for case 2 or 3

;* get butt 1&2 ask sns3, do wet*
; Grab buttons
; Ask for Sense 3
; Three button ?
; No, start A2D
; Leave

;* get sns2, pol bak, ask butt 1&2, do time*
; Grab Sense 2 data
; Ask for butts 1 & 2

; Three button ?
; Yes, leave

; Reverse Polarity
; Sense 2 send
; Sense 3 receive
; Command dew sense ?
; Yes, handle wet
; Leave

;* get temp, ask sns2, do wet*
; Handle time

; Three button ?
; Yes, leave

; Grab temperature data
; Perform algorythm
; Ask for sense 2
; Leave

;* get sns3, pol fwd, ask temp, grab butts*
; Three button ?
; Yes, leave

; Grab Sense 3 data

; Reverse polarity
```

*FIG. 6B*

```
; Sense 3 send
;
; Sense 2 receive

; Ask for temperature
; Command dew sense ?
; Yes, handle wetness
; Leave

Case_Exit:
; Counter2 empty
; No, leave
; Yes, reload

Los_Endos:
; Is the fan commanded on ?
; Yes, turn it on
; Is the lamp commanded on ?
; Yes, turn it on

; Make LED off
; Command dew sense ?
; No, don't turn LED on
; Three buttons ?
; Yes, check night light
; No. Time for bright LED ?
;   Yes, make LED bright

; Wet seen ?
; No, leave

Do_Flash:
; Make LED dim
Make_NiteLite:
; Night light commanded on ?
; Make LED full
Leave_LED:
; Wait for timeout
;*************************************************************
; Grab Butts - called
;*************************************************************
Grab_Butts:
; Grab A2D values
; Too high ?
; Yes, continue
; No, preset button 1
; Button 1 pushed ?
```

FIG. 6C

```
;   Yes, finish
;   No, clear button 1
; Preset button 2
; Button 2 pushed ?
; Yes, continue
; No, must be both
Finish_Butts:
; Sw1 made ?
; Yes, handle sw1
; No. Sw2 Made ?
;   Yes, handle sw2
;   No. Sw3 Made ?
;     Yes, handle sw3
;     No. Both made ?
;       Yes, handle both

; Look for makes

; Sw1 pushed ?
; Yes, make sw 1
; No. Sw2 pushed ?;   Yes, make sw 2
;   No. Sw3 pushed ?
;     Yes, make sw 3
;     No. Both pushed ?
;       Yes, make both
;       No, clear hold
; Leave

Make_Sw1:
; Coming out of hold ?
; No, set made
Sw1_Made:
; Sw1 still pushed ?
; Yes, leave
; No, say so
; Third button present ?
; Yes, do lamp off
; No. Lamp present ?
;   Yes, handle lamp
;   No, turn on fan
; Set timer
Handle_Lamp:
; Is the lamp on
; Yes, turn it off
Lamp_On:
; No, turn it on
; Leave
```

FIG. 6D

```
Lamp_Off:
; Turn lamp off
; Leave

Make_Sw2:
; Coming out of hold ?
; No, set made
Sw2_Made:
; Sw2 still pushed ?
; Yes, leave
; No, say so
; Third button present ?
; Yes, do lamp on
;   No. Lamp present ?
;   Yes, handle fan
Fan_Off:; No, Is wet seen ?
;   No, stop fan
;   Leave
Handle_Fan:
; Is the fan on ?
; Yes, handle off
; No, turn it on
; Set timer
; Leave

Make_Sw3:
; Coming out of hold ?
; No, set made
Sw3_Made:
; Sw3 still pushed ?
; Yes, leave
; No, say so
; Is Night light commanded on ?
; No, command it on and set timer
; Yes, command it off
Set_NiteLite:
; Command on
; Set 12 hours

Make_Both:
; Load 15 seconds
; Leave
Both_Made:
; Both still pushed ?
; Yes, leave
;
; Leave
```

FIG. 6E

```
Leave_ReadSw:
;*************************************************************
; Load Timer - Called
;*************************************************************
; Handle Time - Called
; Both butts helds ?
; Yes, handle counter

; Reinitialize detect count
; Command fan off
; Command night light off

Counter_Handler:
; Already holding ?
; Yes, leave
; No. Has the counter timed out ?
;   No, leave
;   Yes, lockout override handler
; Already sensing ?
; Yes, clear sensing
; No, set sensing
Clear_Sense:
; Clear sensing
Write_EE:
Leave_Time:
  ret
;*************************************************************
; Handle Wet - Called
;*************************************************************
Handle_Wet:
; Is wet seen ?
; Yes, look to see if it's gone
We_Dry:
; No. Are we below threshold ?
;   Yes, leave
;   No. Wet ?
;     No. leave
; Yes, see wet
; Turn on fan
; Reload level
We_Wet:
; Are we above threshold ?
; Yes, leave
; No.  Are we dry yet ?
;   No, leave
;   Yes, see dry
```

FIG. 6F

```
; Set timer
Leave_Wet:
;*************************************************************
; Start A2D - Called
;*************************************************************
Start_A2D:
; Select A2D6 - Temperature
; Start A2D
END
```

FIG. 6G

```
;       AU01-102b
;*******************************************************
;       Reset_Int                   Put input buttons on weak pull-up
;*******************************************************
Reset_Int:
;       Global interrupt disable
;       clear zeroregister
;*******************************************************
;       0       0 1 0, 0  1  0 1
;       -       Tmp    Sw3    -,      Sns3    Sns2    LED     Sw12
;0 0 0 0, 0  0  0 0
;       i i i i, i  i  i i

;       0 0 0 0, 0 0  0 0
;       - - - -, - Sam Fa La
;       0 0 0 0, 0 0  1 1
;i i i i, i i  o o

;       Watchdog is 2048 cyc's And enabled

;       Put the stack at the end of RAM

;       Disable analog comparator

;       Disable Ext Int
;       Enable sleep mode in idle

;       Ensure self program is disabled
;       Start EE Read of 0x00
;       Enable T0 INT
;       Start timer slow 260µ
;       2s settling loop
```

FIG. 14A

```
;       Bring in stored commands
;       Is sensor to be used ?
;       Yes, set command bit
;       Is the lamp relay present ?
;       Yes, say so
;       Start timer for 8µs clock

;       Look for third button
;       A2D enabled, single conversion, /32
;       Left justified
;       Is there a third button ?
;       No, continue
;       Yes, say so
;       Load case count
;       Load level
;       Begin the begin

;*****************************************************
Los Entry:
;       Bit 2 high ?
;       Yes, do case 4
;       No.     Bit 1 high ?
;               Yes, look for case 2 or 3

;*      get butt 1&2 ask sns3, do wet*
; Grab Buttons
;       Ask for Sense 3
;       Three button ?
;       No, start A2D
; Leave
```

FIG. 14B

```
;*****************************************************
Los Entry:
;       Bit 2 high ?
;       Yes, do case 4
;       No.     Bit 1 high ?
;               Yes, look for case 2 or 3

;*      get butt 1&2 ask sns3, do wet*
; Grab Buttons
;       Ask for Sense 3
;       Three button ?
;       No, start A2D
; Leave

;* get sns2, pol bak, ask butt 1&2, do time*
;       Grab Sense 2 data
;       Ask for butts 1 & 2

;       Three button ?
;       Yes, leave

;       Reverse Polarity
;       Sense 2 Send
;       Sense 3 receive
;       Command dew sense ?
;       Yes, handle wet
;       Leave

;* get temp, ask sns2, do wet
;       Handle time
```

FIG. 14C

```
        ;       Three button ?
        ;       Yes, leave

        ;       Grab temperature data
        ;       Perform algorythm
        ;       Ask for sense 2
        ;       Leave

        ;* get sns3, pol fwd, ask temp, grab butts*
        ;       Three buttons ?
        ;       Yes, leave

        ;       Grab Sense 3 data

        ;       Reverse polarity
        ;       Sense 3 send
        ;

;       Sense 2 receive

;       Ask for Temperature
;       Command dew sense ?
;       Yes, handle wetness
;       Leave

Case_Exit:
;       Counter2 empty
;       No, leave
;       Yes, reload
```

*FIG. 14D*

```
Los_Endos:
;       Is the fan commanded on ?
;       Yes, turn it on
;       Is the lamp command on ?
;       Yes, turn it on

;       Make LED off
;       Command dew sense ?
;       No, don't turn LED on
;       Three button ?
;       Yes, check night light
;       No.     Time for bright LED ?
;               Yes, make LED bright

;       Wet seen ?
;       No, leave

Do_Flash:
;       Make LED dim
Make_NiteLite:
;       Night light commanded on ?
;       Yes, make LED full
Leave_LED:
; Wait for timeout
```

*FIG. 14E*

```
;*****************************************************
;       Grab butts - called
;*****************************************************
Grab_Butts:
;       Grab A2D values
;       Too high ?
;       Yes, continue
;       No, preset button 1
;       Button 1 pushed ?
;               Yes, finish
;               No, clear button 1
;       Preset button 2


;       Button 2 pushed ?
;       Yes, continue
;       No, must be both
Finish_Butts:
;       Sw1 made ?
;       Yes, handle sw1
;       No. Sw2 Made ?
;               Yes, handle sw2
;               No, Sw3 made ?
;                       Yes, handle sw3
;                       No. Both make ?
;                               Yes, handle both
```

FIG. 14F

```
;       Look for makes

;       Sw1 pushed ?
;       Yes, make sw1
;       No.     Sw2 pushed ?
;               Yes, make sw 2
;               No. Sw3 pushed ?
;                       Yes, make sw3
;                       No. Both pushed ?
;                               Yes, make both
;                               No, clear hold
;       Leave

Make_Sw1:
;       Coming out of hold ?
;       No, set made
Sw1_Made:
;       Sw1 still pushed ?
;       Yes, leave
;       No, say so
;       Third button present ?
;       Yes, do lamp off
;       No. Lamp present ?
;               Yes, handle lamp
;               No, turn fan off
;       Set timer
Handle_Lamp:
;       Is the lamp off
;       Yes, turn it off
```

*FIG. 14G*

```
Lamp_On:
;       No, turn it off
;       Leave
Lamp_off:
;       Turn lamp off
;       Leave


Make_Sw2:
;       Coming out of hold ?
;       No, set made
Sw2_Made:
;       Sw2 still made ?
;       Yes, leave
;       No, say so
;       Third button present ?
;       Yes, do lamp on
;               No. Lamp present ?
;                       Yes, handle fan
Fan_Off:
;                       No. Is wet seen ?
;                       No, stop fan
;       Leave
Handle_Fan:
;       Is the fan on   ?
;       Yes, handle off
;       No, turn it on
;       Set timer
;       Leave
```

*FIG. 14H*

```
Make_Sw3:
;       Coming out of hold      ?
;       No, set made
Sw3_Made:
;       Sw3 still pushed ?
;       Yes, leave
;       No, say so
;       Is Night light commanded on ?
;       No, command oit on and set timer
;       Yes, command it off
Set_Nitelite:
;       Commandon
;       Set 12 hours

Make_Both:
;       Load 15 seconds
;       Leave
Both_Made:
;       Both still pushed ?
;       Yes, leave
;
;       Leave

Leave_ReadSw:
;*****************************************************
```

FIG. 14I

```
;       Load Timer - Called
;*******************************************************
;       Handle Time - Called
;       Both butts held ?
;       Yes, handle counter

;       Reinitialize detect count
;       Command fan off
;       Command night light off

Counter_Handler:
;       Already holding ?
;       Yes, leave
;       No. Has the counter timed out ?
;               No, leave
;               Yes, lockout override handler
;       Already sensing ?
;       Yes, clear sensing
;       No, set sensing
Clear_Sense:
;       Clear sensing
Write_EE
;       ret
Leave_Time:
;       ret
;*******************************************************
;       Handle_Wet - Called
;*******************************************************
```

FIG. 14J

```
Handle_Wet:
;       Is wet seen ?
;       Yes, look to see if it's gone
We_Dry:
;       Dry mode 1 ?
;       No, seek Dry 2
;       Yes, Are we below threshold ?
;               Yes, leave
;               No. Wet ?
;                       No, leave
;       Yes, see wet
;       Turn on fan
;       Reload level
;       Leave wet
Seek_Dry2:
;       Command dry 3
;       Yes, seek dry 3
;       No, figure temp
;       Are we below threshold ?
;               Yes, leave

;               No. Wet ?
;                       No, leave
;       Yes, see wet
;       Turn on fan
;       Reload level
;       Leave wet
```

*FIG. 14K*

```
Seek_Dry3;
;       Call history
;       Are we below threshold ?
;               Yes, leave
;               No. Wet ?
;                       No, leave
;       Yes, see wet
;       Turn on fan
;       Reload level
;       Leave wet
;*****************************************************
;       Figure Temp - Called
;*****************************************************
Figure_Temp:
;       Input A2D
;       Input Temp
;       Build result
;       ret
;*****************************************************
;       Get History - Called
;*****************************************************
Get_History:
;       Divide sum
;       Load rotate value
Build_Loop:
;       Move wet values
;       Build dew history
;       ret
```

*FIG. 14L*

```
;*******************************************************
;        Start A2D - Called
;*******************************************************
Start A2D:
;        Start A2D
END
```

FIG. 14M

VENTILATION CONTROL SYSTEM AND METHOD

BACKGROUND

1. Technical Field

The present disclosure pertains to the removal of moisture vapor from enclosed areas and, more particularly, to a ventilation system having a controller that controls exhaust fan operation based on relative humidity, temperature, and local dew point determinations in the surrounding air.

2. Description of the Related Art

Moisture vapor, which is the presence of condensed water in the surrounding air, can pose a health risk, and condensate resulting from water in the air can damage or destroy structures, equipment, pharmaceuticals, and food items. Reliable protection against moisture in the air is necessary to properly maintain dry conditions where considerable economic loss may result from a user or maintenance personnel either not switching on an exhaust fan manually or only activating the exhaust for such short times as to be ineffective against the accumulation of both fungal and bacterial growth. Such organisms threaten the health of occupants and the integrity of the structures or objects stored therein.

BRIEF SUMMARY

The present disclosure provides a solution to fungal and bacterial growth on the interior of enclosed structures and on materials stored in environments that are subject to continuous or continual moisture vapor.

The present disclosure is directed to a system and method for exhausting moisture vapor from an enclosed environment where moisture condensation is undesirable, ideally before condensation forms on structures and objects in the environment and even more ideally before moisture vapor is visible.

In accordance with one aspect of the disclosure, a fan switch controller is provided that responds to local dew point and activates a ventilation system, such as turning on an exhaust fan, to exhaust air containing the moisture vapor. Preferably, manual switches, such as push-button switches, are provided to enable manual control of the fan.

In accordance with another aspect of the disclosure, the fan switch controller is configured to operate a fan and a lamp when a lamp relay and supporting components are provided. Ideally, firmware detects the presence of these components and operates the relays accordingly.

In accordance with a further aspect of the present disclosure, an LED light indicates when power is available or when the fan relay is energized, and it flashes at a two-second rate when moisture is detected. Ideally, a timer turns the fan off after a set period of time, such as 20 minutes, when moisture vapor is no longer detected.

BRIEF DESCRIPTION OF THE SEVERAL VIEWS OF THE DRAWINGS

The foregoing features and advantages of the present disclosure will be more readily appreciated as the same become better understood from the following detail description when taken in conjunction with the accompanying drawings, wherein:

FIGS. 6A-G contain a listing of pseudo code for a fan switch controller formed in accordance with the present disclosure;

FIGS. 14A-M contain a listing of pseudo code associated with a further aspect of the present disclosure.

DETAILED DESCRIPTION

Figure 1B:
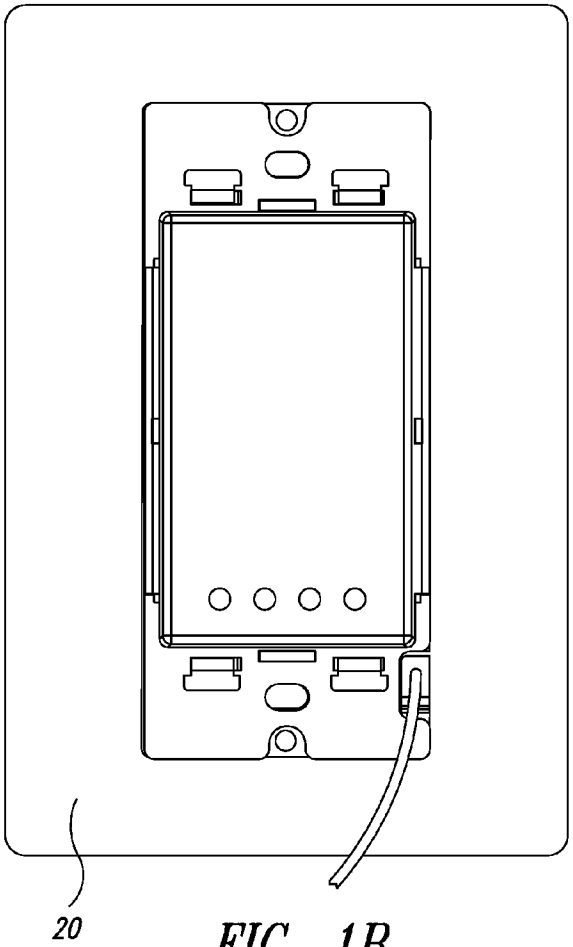
FIG. 1A is a front plan view and FIG. 1B is a rear plan view of a device for controlling an exhaust fan in accordance with the present disclosure.

Further aspects of the system and method will become apparent from consideration of the drawings and the ensuing description of preferred embodiments of the disclosure. A person skilled in the art will realize that other embodiments of the disclosure are possible and that the details of the apparatus can be modified in a number of respects, all without departing from the scope of the disclosure. Thus, the following drawings and description are to be regarded as illustrative in nature and not restrictive.

In the following description, certain specific details are set forth in order to provide a thorough understanding of various embodiments of the disclosure. However, one skilled in the art will understand that the disclosure may be practiced without these specific details. In other instances, well-known structures associated with switches, sensors, and controllers have not been described in detail to avoid unnecessarily obscuring the descriptions of the embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to." The words "switch" and "fan" as used herein include all known forms of these devices, which are readily commercially available and will not be described in detail herein except in relation to the specific embodiments of the disclosure.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment.

Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments. The following description of the several embodiment(s) is merely exemplary in nature and is in no way intended to limit the disclosure, its application, or uses.

Condensation occurs when moisture in the ambient air forms into visible moisture (moisture vapor), such as mist, fog, or steam, or when moisture in the air forms into water droplets and collects at a point of contact between the moisture laden air and a cold surface, such as a window, blade of grass, or wall. As described previously, moisture in the air and on surrounding surfaces is conducive to fungal and bacterial growth as well as to the corrosion of surfaces and other objects. Understanding the conditions that cause condensation is important to effectively controlling condensation formation and mitigating or eliminating the effects of condensate.

Relative humidity is a percentage of the actual amount of moisture in the air versus what the total amount of moisture could be held in the air. In other words relative humidity is an expression of the degree of saturation of the ambient air. As a rule cold air holds fewer water molecules than warmer air holds. If air is completely saturated with water molecules the humidity is 100%.

In relationship to the humidity is dew point. Dew point is the temperature (in degrees) to which air must be cooled in order to be saturated with water vapor already in the air. When the two are compared, i.e., relative humidity and dew point, the difference reveals how close the air is to being 100% saturated. This difference is called the temperature-dew point spread.

The present disclosure utilizes measurements of the relative humidity vis-à-vis the ambient temperature to determine the point at which an exhaust fan should be switched on in order to reduce or eliminate the possibility of condensation forming in an enclosed area. In accordance with one aspect of the present disclosure, the system utilizes a device that will track the dew point/humidity and temperature relationships in a room. It will see changes and start to anticipate a condensation situation arising before the condensation forms. For example, in accordance with one approach, based on gathered information the device will activate a ventilation fan at the point the humidity in a room reaches a set percent, such as 79%.

In another approach, the device detects humidity or relative humidity and makes decisions based on the humidity level at rest and a rise in humidity over time, such as in the case of a shower or bath versus an open window in a bathroom. For example, a sitting relative humidity of 60% with a rise of 10% over 1 minute would result in the device activating an exhaust fan. The device continues to monitor conditions, such as the relative humidity and the time, and if it sees the relative humidity dropping back to near the at rest humidity over time (such as over a three minute period) the device will then allow the exhaust fan to remain on for a drying period of time, assuming the relative humidity value stays close to or within a set range of the original at rest relative humidity.

Thus, the present disclosure is directed to a system and method for removing moisture vapor in an enclosed environment, ideally before condensation forms on structures and objects in the environment, where moisture condensation is undesirable.

In accordance with an aspect of the present disclosure, a system to control ventilation of air in an enclosed area is provided. The system includes a first sensor adapted to detect the presence of moisture vapor in the air, a second sensor structured to detect air temperature; and a circuit coupled to the first and second sensors and structured to determine local dew point and to control ventilation of the air in response to the calculation of local dew point based on outputs of the first and second sensors.

In accordance with another aspect of the disclosure, a ventilation system controller is provided that senses local dew point and automatically activates the ventilation system, such as turning on an exhaust fan, to clear the room of the moisture vapor. Preferably, manual switches, such as push-button switches, are provided to enable manual control of the fan. When activated, the fan pulls air from the enclosed area and exhausts it to the exterior, which draws fresh air into the enclosed area that has a much lower moisture content. Preferably this will occur before condensate forms on the structure or objects in the enclosed area, and even before moisture vapor in the air is visible to the human eye.

In accordance with another aspect of the disclosure, the fan switch controller is configured to operate a fan and a lamp when a lamp relay and supporting components are provided. Ideally, firmware detects the presence of these components and operates the relays automatically.

In accordance with a further aspect of the present disclosure, an LED light indicates when power is available or when the fan relay is energized, and it flashes at a two-second rate when moisture is detected. Ideally, a timer turns the fan off after a set period of time, such as 20 minutes, when moisture vapor is no longer detected.

In accordance with another aspect of the present disclosure, a controller for an exhaust fan is provided, the controller having a sensor adapted to detect humidity, a sensor adapted to sense the temperature in the environment where the humidity is sensed, and a circuit coupled to the sensors and adapted to control operation of the fan in response to a determination of local dew point based on the sensing of humidity and temperature.

In accordance with another aspect of the disclosure, a controller for an exhaust fan is provided that includes a manual switch to enable manual activation and deactivation of a lighting system.

In accordance with another aspect of the present disclosure, the controller is fully automated in that it automatically activates the fan when the local dew point is within a range of dew points or within a range of dew point and temperature or at a set dew point. Ideally, that dew point range is from 2 degrees to 8 degrees Fahrenheit. Preferably, the controller maintains activation of the fan for a set period of time after moisture vapor is detected and for a set period of time after moisture has dropped below dew point. Alternatively, the controller can be adapted to permit manual deactivation of the fan or to permit both manual deactivation and automatic deactivation of the fan.

In accordance with another aspect of the present disclosure, an electronic circuit for sensing moisture in any enclosed space (such as a bathroom with a shower) is provided, preferably a humidity sensor that is coupled to a microprocessor that in turn receives a temperature signal from a thermistor. Ideally, the humidity sensor signal is processed by the processor to yield a dew point temperature that is compared to the sensed temperature.

In accordance with another aspect of the present disclosure, a controller for a fan is provided that includes a first sensor adapted to detect the presence of moisture vapor; a second sensor configured to detect temperature; and a circuit coupled to the first and second sensors and adapted to determine local dew point and to control operation of the fan in response to the calculation of local dew point.

Figure 1A:
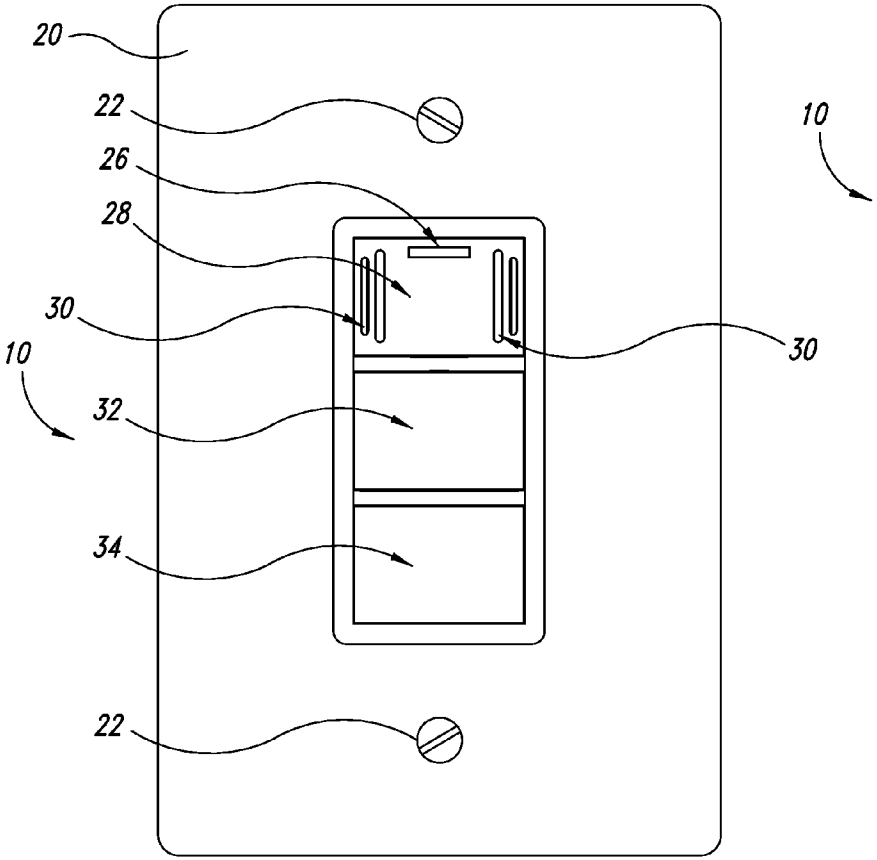

Referring next to FIGS. 1A and 1B, shown therein are front and rear views of a switch controller 10 for mounting in a conventional switch box 12 (shown in FIG. 3) that has a main body 13 of generally rectangular shape formed by two long side walls 14 and two short side walls 16, all orthogonal to a common back wall 18. The side walls 14, 16, and the back wall 18 define an open rectangular box with a hollow interior that houses the electrical components. The side walls 14 include tabs 15, which define threaded holes 17. The switch controller 10 is mounted to the box 12 by screws (not shown) passing through the threaded holes 17. A face plate 20 (shown in FIGS. 1A and 1B) is mounted over the front of the box 12 after the electrical components are placed in the box 12. The face plate 20 is attached to an existing or new switch box 12 in a known manner, i.e., with two screws 22 passing through corresponding openings in the face plate 22 and into threaded holes in the underlying circuit board or in the switch box 24, depending on the application.

The switch controller 10 includes on the front thereof an indicator light 26 positioned above a sensor inlet 28 that has a plurality of openings 30. Below the openings 30 is a first switch 32. In this design approach, the first switch 32 is used to manually turn the fan on, and below the first switch 32 is a second switch 34 that is used to manually turn the fan off. These components are affixed to a mounting board that includes the electrical circuitry for controlling operation of the fan. Other configurations are possible. For example, for a fan-only configuration the top button is used to turn the fan on and the bottom button is used to turn the fan off. For a fan and lamp combination, the top button is used to toggle the lamp on and off, and the bottom button is used to manually toggle the fan on and off. Firmware is provided that selects the function for each switch based on the components seen on the control board.

Figure 2:
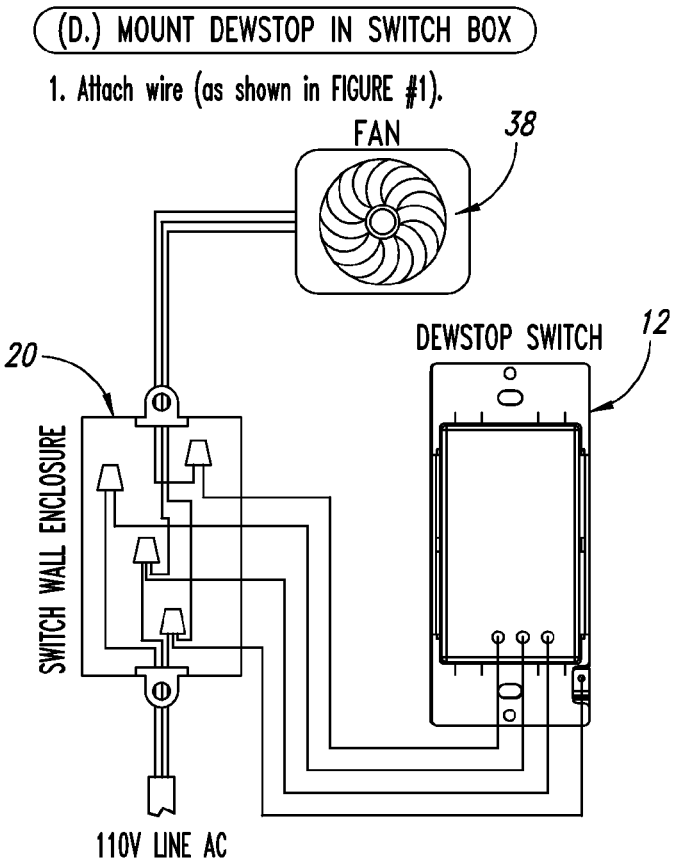
FIG. 2 is an electrical schematic illustrating the moisture vapor removal system of the present disclosure.

FIG. 2 illustrates the conventional electrical connections made in the switch box 12 for coupling the control switch 10 to a fan motor 38. The system is designed for use with only 120V AC powered fans. Only #14 or #12 copper wiring should be used. It is to be understood, however, that electrical power systems using other than 120V AC can be used so long as appropriate modifications are made to the electrical circuitry of the control switch 10, as is well within the knowledge of one of ordinary skill in this technology.

Figure 3:
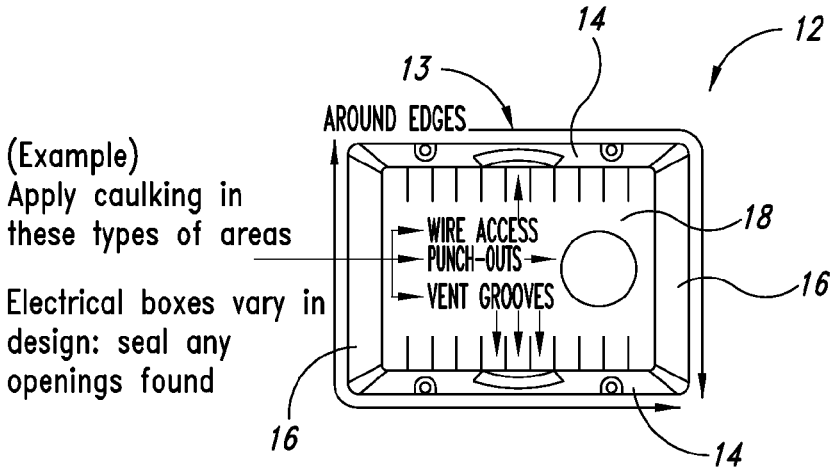
FIG. 3 is an illustration of an electrical box in which the control switch is mounted.

Because older facilities may experience drafts inside the walls where the switch box 12 is located, it may be necessary to seal any openings in the switch box 12 in order for the control switch 10 to properly function. This can be done by using available standard painter's caulking to seal every opening, including openings where the electrical wires pass through the box 12, as shown in FIG. 3. It is also recommended that the perimeter around the box between the wall board and the electrical box be sealed in order to stop heat loss and enable the control switch 10 to sense the conditions in the room instead of the drafts inside or around the box 12.

The following is a hardware description of the control switch 10. The switch is designed to pass 85 Vac to 265 Vac, 50-60 Hz power through relays rated at an appropriate amperage, such as 5 A in some cases. Any load so rated may be connected to these relays. The main power source, in this case a 110V AC conventional home power supply, provides power to the controller 10, which generates an operational lower voltage. It is to be understood that these values are application dependent. For example, a relay could have a higher amperage capability to handle a larger fan. Also, the hardware can be designed to handle a 240 volt power source.

While three push-button switches may be mounted on the circuit board, only the lower two first and second switches 32, 34 are presently used. These switches are operated by the user to manually turn the fan on and off. An LED is visible to the operator, and this provides a visual indication of the controller status.

The following firmware description includes a version of software in the controller that senses the lamp relay components, and this determines the function that the push-buttons perform. The firmware handles the timer, interprets temperature and moisture readings, and drives the LED when moisture is detected.

FIG. 6 is a listing of pseudo code for the controller software associated with this particular design. Applicant recognizes that one of skill in this technology will understand the basis for the control algorithm that is illustrated in the pseudo code and be able to implement it into a target programming language by reference thereto. Hence, the code will not be explained in detail herein.

Configurations

Fan Only

For an exhaust fan only configuration, the relay for the lamp is excluded in the construction. The software detects the absence and interprets the upper push-button, in this case the first switch 32, as a "fan on" command. The lower push-button, in this case the second switch 34, is seen as a "fan off" command.

Fan and Lamp

When the lamp relay and supporting components are installed, the software interprets the upper push-button, first switch 32, as a toggle for the lamp on and off commands. The lower push-button, second switch 34, is seen as a toggle for fan on and off commands.

In each of these configurations, local dew-point is calculated, as described more fully below, and the exhaust fan is activated to clear moisture vapor from the area. An LED is lit to a dim level to show that power is available or that the fan relay is energized, and it will flash at a two-second rate to indicate that moisture vapor is detected.

Operation

Fan Only

Manually pressing the upper button, the first switch 32, will activate the exhaust fan and set a timer. Detecting moisture will also command the fan on, but the timer will not be set, and the fan will remain on until moisture is no longer detected. While moisture is detected, the LED will pulse on and off at a two-second rate.

It is to be understood that the timer can be set for the necessary period of time to clear the space or to meet the local needs of the application or local constraints, such as availability of electricity. In some cases the time minimum could be 15 minutes, and in some cases it could be as much 60 minutes. In most cases the time is in the range of 20 minutes to and including 30 minutes, although it could vary from 15 to 60 minutes.

If condensate or moisture is not detected, the user can press and release the lower push-button and turn the fan off. If condensate or moisture is detected, pressing and releasing the upper or lower push-button will have no effect. The fan will be turned off automatically by the controller when the 20-minute timer times out.

Fan and Lamp

Ideally, the LED is provided to indicate that power is available, the fan is on, that moisture is sensed, or override is active or any combination of the foregoing. In a representative embodiment as shown herein, when power is available, the LED will be lit at a dim level. Pressing the upper button 32 will toggle the lamp on and off. The lamp push-button does not affect the operation of the fan, and the dew-point detection does not affect operation of the lamp. There is no time-out associated with the lamp.

Pressing and releasing the lower push-button 34 will turn the exhaust fan on, which sets the 20-minute timer, and, if moisture is not detected, pressing and releasing the lower push-button 34 will deactivate the fan. In all other ways the fan will function as described above in the Fan Only operation description.

While no override is shown for the moisture detection circuit, one can be provided.

Temperature and Humidity Detection

The main control board of the fan switch contains a connector into which the sensor board is attached. A thermistor or equivalent component is provided that is structured to sense and return air temperature data. A grid is provided that generates moisture level data. The output signals with the data can be sent to a local memory to store the data or be sent directly to a processor for determination of a dew point value. Preferably, firmware logic translates the returned moisture level data and temperature data into the dew point value. The exhaust fan is activated when the threshold dew point value is reached, as described in more detail below.

Electrical

The operational current draw of the fan switch logic is approximately 90 mA maximum for the fan only configuration and 150 mA maximum for the fan and lamp configuration at present. The quiescent current draw for the fan switch is approximately 0.4 mA.

In a preferred version, the switching on and off of the fan motor is controlled by a sensing circuit that operates on the basis of a sensed temperature value and a sensed relative humidity and dew point determination. For the determination of temperature, an NTC Thermistor/Voltage divider circuit provides an inversely proportional voltage return. Depending on the value of thermistor chosen, a scaling algorithm is applied to fit the range of expected values to fill the range available in the 8-bit analog-to-digital conversion. This signal level or value is the temperature.

The relative humidity detection also provides a signal level to an analog-to-digital converter, which returns a numerical value signal. The simple approximation of:

$$RH=100-5(T-Td) \text{ is used,}$$

where:

RH=relative humidity

T=recorded temperature in Fahrenheit, and

Td is the Dew Point Temperature in Fahrenheit.

By combining RH and T (inverse), a dew point value is received. For example, the dew point value would be 133, but 5 is subtracted in calculating, so the threshold is a count of 128. When a value of less than 128 is received, there is no moisture vapor or condensation. When the value is above 128, there is dew (condensation or moisture vapor).

No table is used. Rather, by using inverse values and an initial scaling factor with an offset, all dew point values for temperatures from ~50° F. to ~112° F. can be placed at exactly 128.

Testing

Figure 4:
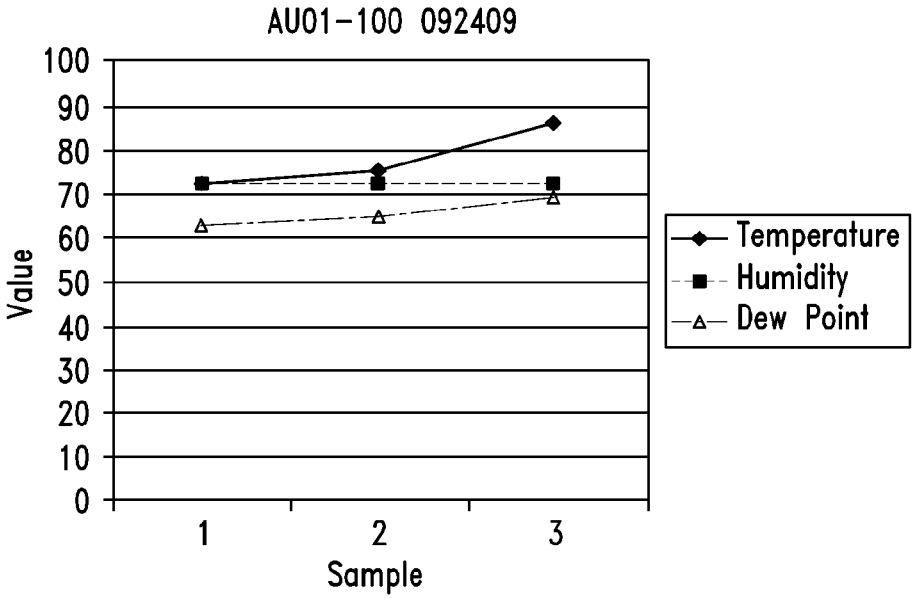
FIG. 4 is a chart of testing performance in accordance with one aspect of the present disclosure.

Testing was done to validate the dew sense algorithm that opens the detection threshold to ~5.5° F. and to verify that the addition of a dew sense override feature has not affected the performance of the device. Initial testing focused on beginning room temperatures of 70° F. nominal at 60% humidity. Many runs were made, and FIG. 4 shows typical performance. The threshold is seen when dew point temperature is within from 5.5° F. to 8° F. of room temperature. The chamber was opened and the fan switch was seen to be below threshold while the chamber humidity was still high. Sample 1 was taken when the chamber was closed. A single steamer was turned on, and sample 2 was taken when fog was first seen to leave moisture on the mirrors at the 4' level. Sample 3 was taken when the fan switch first detected moisture. The time span for all three samples is 10 minutes.

Figure 5:
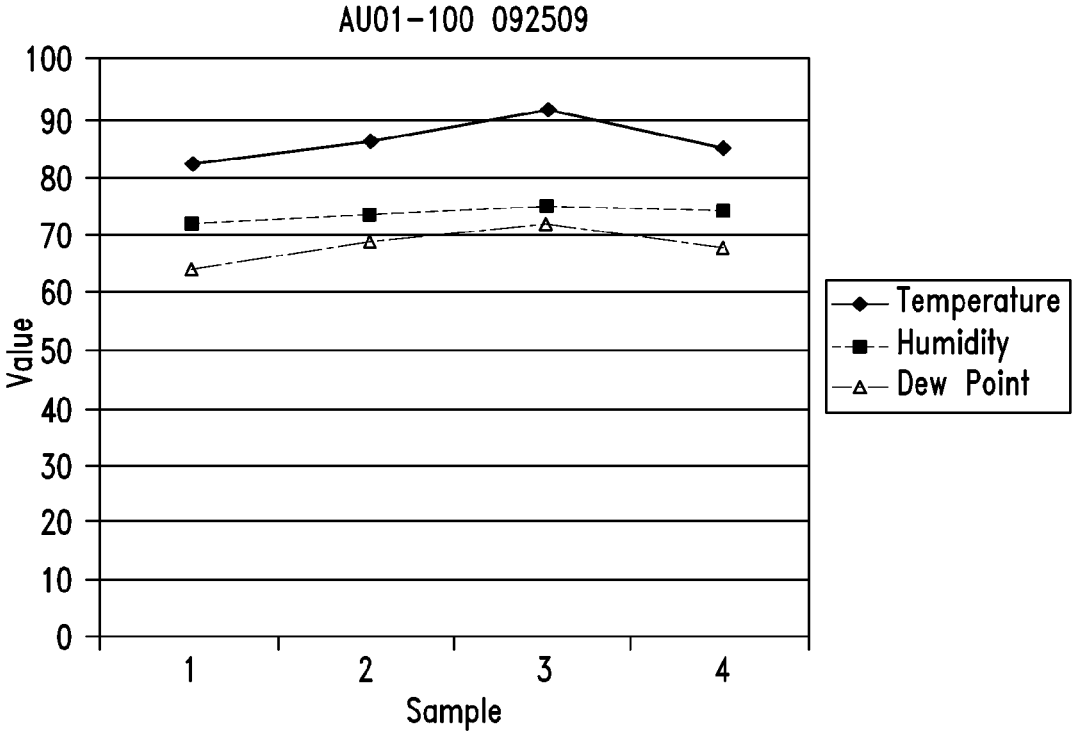
FIG. 5 is a chart of testing performance in accordance with a further aspect of the present disclosure.

FIG. 5 shows testing in accordance with another aspect of the present disclosure in which testing was done at elevated temperatures and with modification to the circuit. The room was soaked at 80° F. to 90° F. for 2 hours before testing was commenced. The chamber was run several times and the graph in FIG. 5 depicts one of the runs. A single steamer was started and sample 1 was taken. Sample 2 was taken when the fan switch triggered. The chamber was run until a temperature of 90° F. was reached and both the steamer and the heat lamp were turned off. A ceiling fan was turned on and the room was ventilated. Sample 4 was taken when the fan switch dropped the dew sense aspect, i.e., dew sense was inactive.

During each test, the moment the fan switch detected moisture, the room was entered and a visual observation was made. In each case the mirrors on all walls were fogged, but the moisture level was low. The fan switch bezel and the surrounding walls felt dry and the air felt moist.

Figure 7:
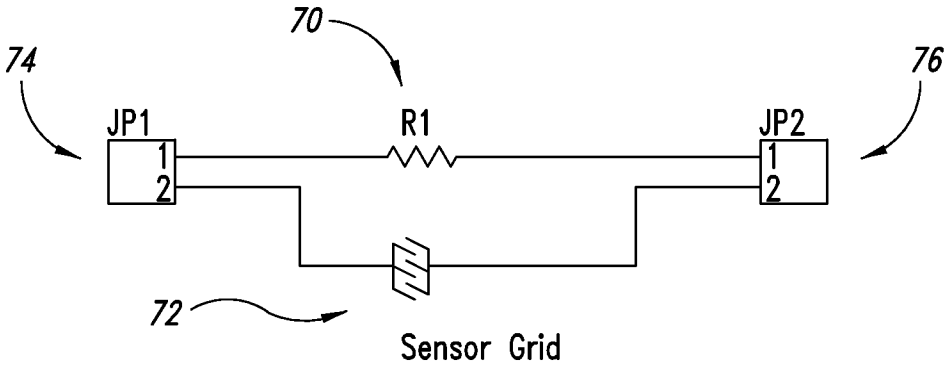
FIG. 7 is a schematic of a fan controller sensor circuit formed in accordance with one aspect of the present disclosure.

Note on the graphs (FIGS. 4 and 5) that the initial temperature and subsequent reading differ. As described therein, the results presented in FIG. 5 were run at initial elevated temperatures FIG. 7 is a schematic of a fan controller sensor circuit 70 formed in accordance with one aspect of the present disclosure. A moisture or humidity sensor grid 72 is shown coupled to a first circuit JP1 and a second circuit JP2 (74, 76) that in turn are coupled together via a thermistor R1. Moisture is detected by the grid 72, resulting in a change in the state of current flow in the first and second circuits JP1 and JP2. This is processed to generate a control signal for a ventilation system. Similarly, air temperature is sensed by the thermistor R1, and the signal is received by the first and second circuits JP1 and JP2.

Figure 8:
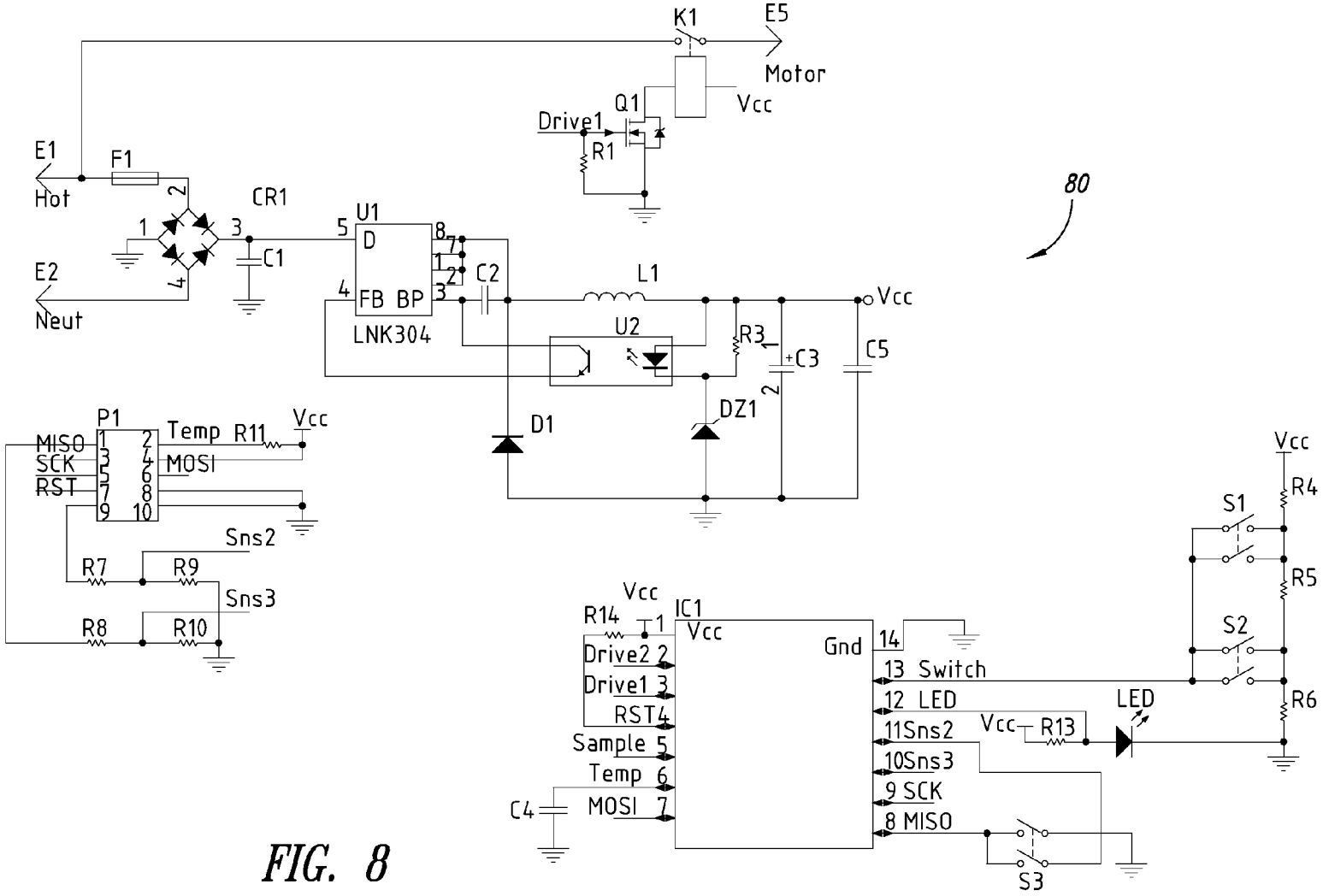
FIG. 8 is a schematic of a fan controller sensor formed in accordance with another aspect of the present disclosure.

FIG. 8 is a schematic of a fan controller sensor circuit 80 formed in accordance with another aspect of the present disclosure. Here a resistor (denoted R1, which is different than thermistor R1 of FIG. 7) couples the gate of transistor Q1 to ground. The gate of Q1 is controlled by the signal on Drive1, which is taken from pin3 on integrated circuit 101. Q1 controls the actuation of a switch K1 that couples a motor line E5 to a hot line E1.

Figure 9:
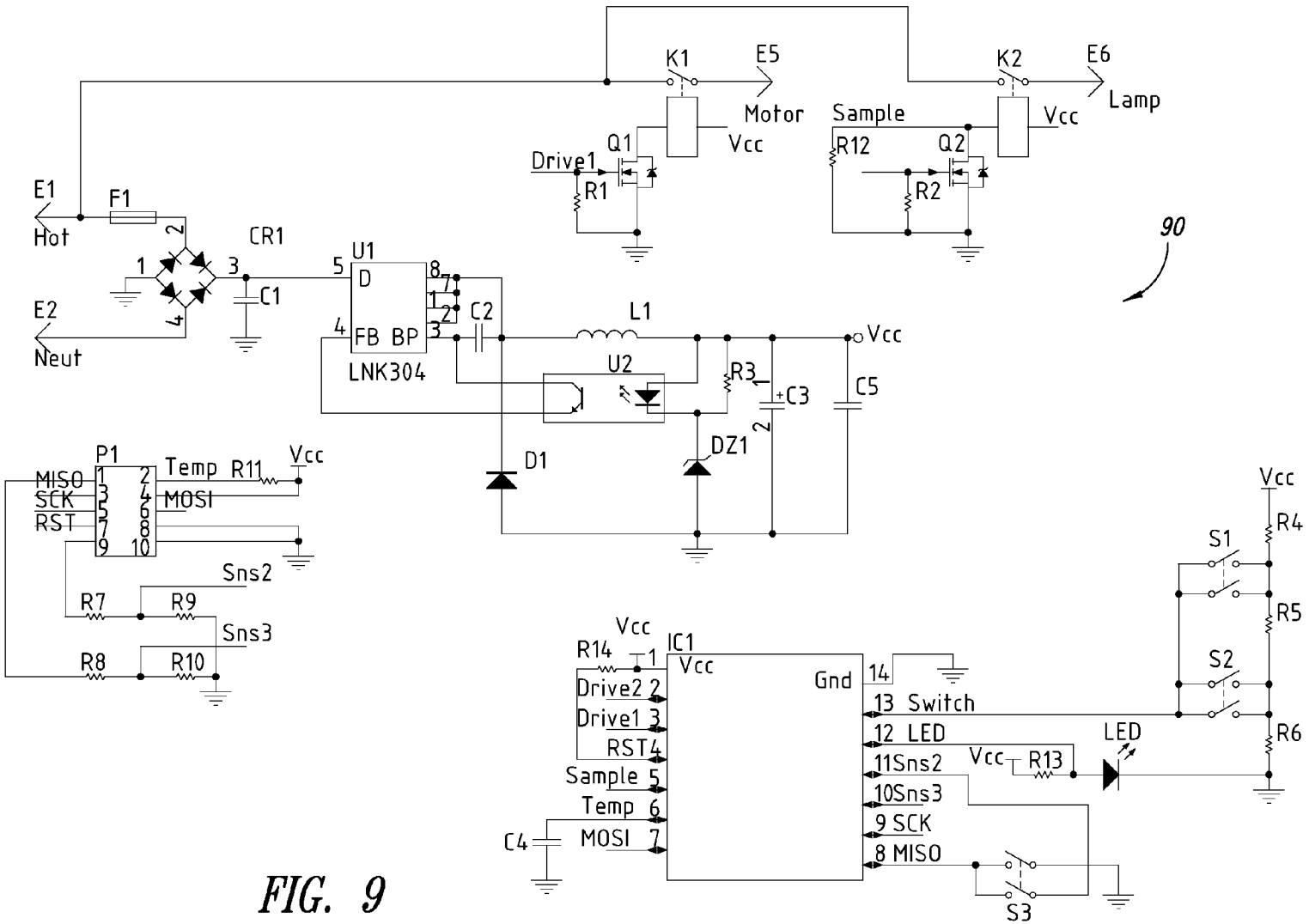
FIG. 9 is a schematic of a fan controller sensor formed in accordance with a further aspect of the controller of FIG. 8.

FIG. 9 is another schematic of a fan controller sensor 90 formed in accordance with a further aspect of the controller circuit 80 of FIG. 8. Here an additional switch K2 is provided for a Lamp on line E6. The switch K2 is controlled by transistor Q2 that has its gate coupled to line Drive2 which is taken from pin 2 on IC1.

JP1 and JP2 of FIG. 7 are mated to P1 of FIGS. 8 and 9. The term temp at pin 2 and ground of pin 10 of P1 is the return through thermistor R1 on FIG. 7. The terms Sns2 and Sns3 at R9 and R10 through pins 1 and 9 are sources and return through the sensor grid of FIG. 7.

In accordance with a further aspect of the present disclosure, the switch controller can be configured to have the following operational characteristics:

As described above, push-button switches exist to manually turn the fan motor on and off. A single firmware version is provided, which is able to determine the mechanical configuration and to perform according to that configuration. For example, when the third push-button and the lamp relay are not installed the firmware operates the fan switch board as follows:

Upper Button—Center Location

When moisture is not detected, pressing and holding the Upper Button has no effect. When the button is released the fan relay is energized and the fan will come on. A 20-minute run timer is set. At the end of 20 minutes the fan will be turned off.

Bottom Button—Bottom Location

When the button is released the fan relay is de-energized and the fan will turn off. If moisture is detected the Bottom Button has no effect.

Override Feature

If both push buttons are held for 15 seconds the dew-point sense system is deactivated. If the fan was running, it will shut off. When the dew-point sense system is deactivated, pressing and holding both push buttons for 15 seconds will reactivate the system. If the buttons are held beyond 15 seconds there is no effect.

Humidity and Temperature Sensors—Top Location

The humidity and temperature sensors are mounted to the sensor board, which is housed in the upper cover. This combination provides the information from which dew-point is determined. The dew-point threshold is what drives the fan switch commands. When the dew-point threshold is reached the fan relay is energized and while moisture is seen the timer will remain reset at 20 minutes. When moisture is no longer detected the timer will be allowed to count down. At the end of 20 minutes the fan will be shut off.

LED Indication—TOP Location

When dew sense is active, an LED indicates that the fan relay is energized and that the dew-point threshold has been reached. When the fan relay is energized but dew is not seen, the LED will be on solid. When dew is seen the LED will pulse dim every 2 seconds.

Power

The AU01-101a circuit board can pass 120 Vac or 240 Vac at a maximum of 3 Amps to the Fan output.

The table below lists the quiescent power draw in all operational modes. The readings in the first two columns have the dew sense circuit active while the last two readings are with the dew sense overridden.

| Dew Sense Active | | Dew Sense Inactive | |
|---|---|---|---|
| Idle | Fan On | Idle | Fan On |
| 0.45 mA | 0.88 mA | 0.49 mA | 0.89 mA |

In accordance with still yet a further aspect of the present disclosure, the switch controller can be configured to have the following operational characteristics:

When the third push-button is not installed, and the lamp relay is installed the firmware operates the fan switch board as the FS-200. The FS-200 operates as follows:

Upper Button—Center Location

The Upper Button toggles the Lamp on and off. This button does not affect the operation of the dew-point sensing circuit or the fan in any fashion.

Bottom Button—Bottom Location

The Bottom Button toggles the Fan on and off. Pressing and releasing the button turns the fan on and sets the 20-minute timer.

If the fan is on and moisture is not detected, pressing and holding the Bottom Button has no affect. When the button is released the Fan relay is de-energized and the Fan will turn off. If the fan is on and moisture is detected the Bottom Button has no affect.

Override Feature

If both push buttons are held for 15 seconds the dew-point sense system is deactivated. If the fan was running it will shut off. When the dew-point sense system is deactivated, pressing and holding both push buttons for 15 seconds will reactivate the system. If the buttons are held beyond 15 seconds there is no affect.

Humidity and Temperature Sensors—Top Location

The Humidity and Temperatures Sensors are mounted to the sensor board, which is housed in the upper cover. This combination provides the information from which dew-point is determined. The dew-point threshold is what drives the fan switch commands. When the dew-point threshold is reached the fan relay is energized and while moisture is seen the timer will remain reset at 20 minutes. When moisture is no longer detected the timer will be allowed to count down. At the end of 20 minutes the fan will be shut off.

Ideally the openings in the upper cover are louvered, and the relative humidity sensor is mounted to face the louvered opening. This has been found to improve the response time of the system.

LED Indication—Top Location

An LED indicates that the fan relay is energized and that the dew-point threshold has been reached. When the fan relay is energized but dew is not detected, the LED will be on solid. When dew is seen the LED will pulse dim every 2 seconds.

Power

The AU01-101a circuit board can pass 120 Vac or 240 Vac at a maximum of 3 Amps to both the Fan and the Lamp output. Do not combine these paths for a single 6 Amp source since both paths would need to be energized and de-energized at exactly the same time to avoid putting the 6 Amp load on a single relay.

The table below lists the quiescent power draw in all operational modes. The readings in the first four columns have the dew sense circuit active while the last four readings are with the dew sense overridden.

| Dew Sense Active | | | | Dew Sense Override | | | |
|---|---|---|---|---|---|---|---|
| Idle | Fan On | Lamp On | Both On | Idle | Fan On | Lamp On | Both On |
| 0.48 mA | 0.88 mA | 0.89 mA | 1.06 mA | 0.52 mA | 0.88 mA | 0.89 mA | 1.07 mA |

Figure 10:
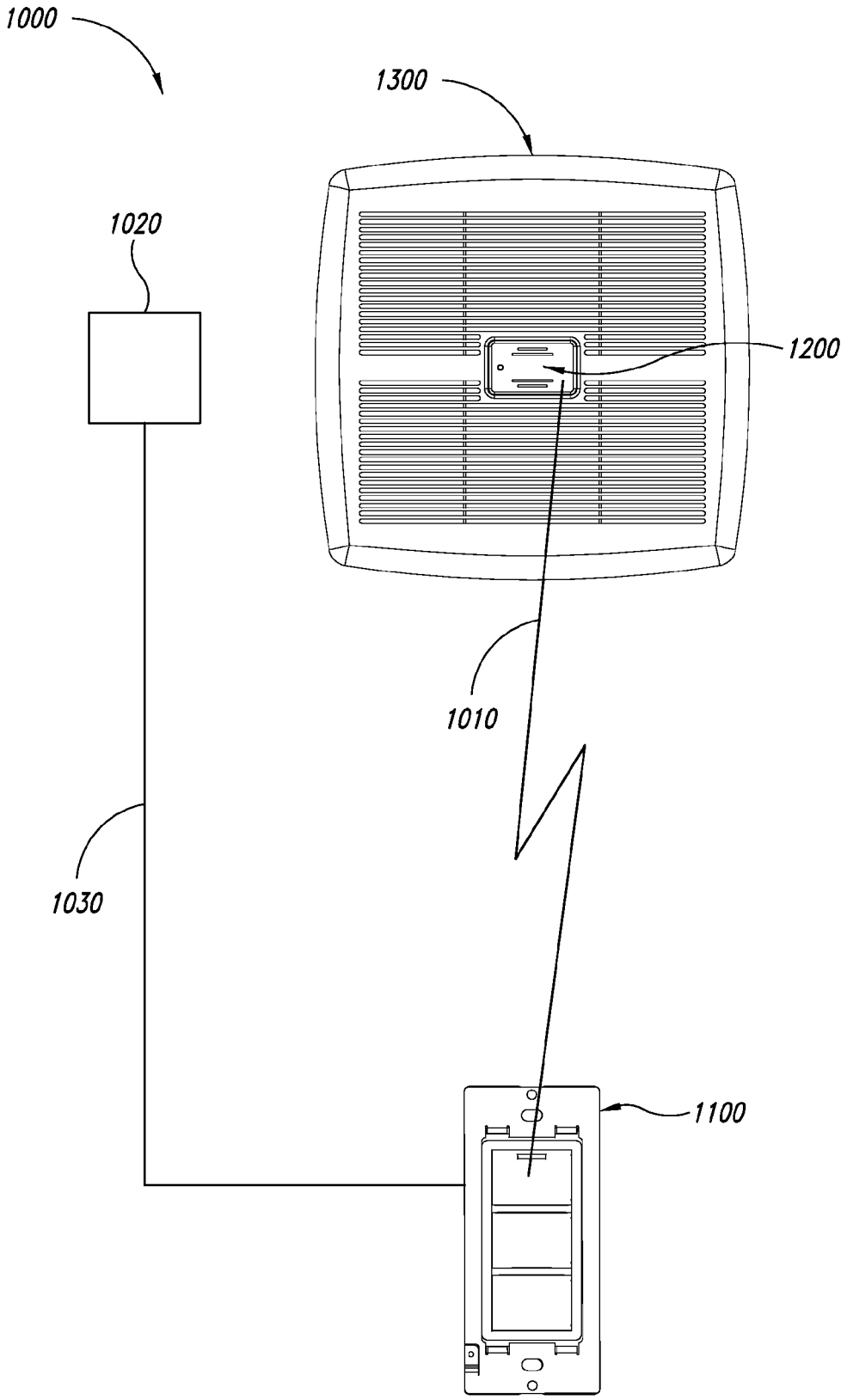
FIG. 10 shows a schematic of a moisture control system in accordance with another aspect of the present disclosure.

FIG. 10 shows the components of a moisture control system 1000 according to one illustrated embodiment. A switch controller 1100 is in wireless communication with an atmospheric environment sensor assembly 1400. The atmospheric environment sensor assembly 1400 is located remotely from the switch controller 1100. Typically, the atmospheric environment sensor assembly 1400 is coupled or affixed to a fan grill assembly 1300, which is typically located on a wall or a ceiling of a room, while the switch controller 1100 is typically located on a wall of the room.

The atmospheric environment sensor assembly 1400 may sense moisture in the air or temperature or both. The atmospheric environment sensor assembly 1400 may include circuitry and logic such as firmware logic that determines a dew-point based on the sensed moisture or temperature or both, as described above with respect to previous embodiments. The atmospheric environment sensor assembly 1400 located in the grill assembly 1300 is configured to wirelessly provide communication, such as by radio frequency (RF) communication, using wireless communications 1010 to the wall-mounted switch controller 1100.

The switch controller 1100 is configured to receive wireless communications 1010 from the atmospheric environment sensor assembly 1400. The switch controller 1100 may include circuitry and logic such as firmware logic that operates a fan 1020 associated with the grill assembly 1300. The fan motor and the switch controller 1100 may be electrically coupled via wiring 1030. The switch controller 1100 may selectively turn the fan motor 1020 on and off via the wiring 1030.

In some embodiments, the wiring 1030 may also be used to provide electrical power to the atmospheric environment sensor assembly 1400. In some embodiments, the wiring 1030 or additional wiring not shown may provide a wired communications link between the atmospheric environment sensor assembly 1400 and the switch controller 1100.

Figure 11A:
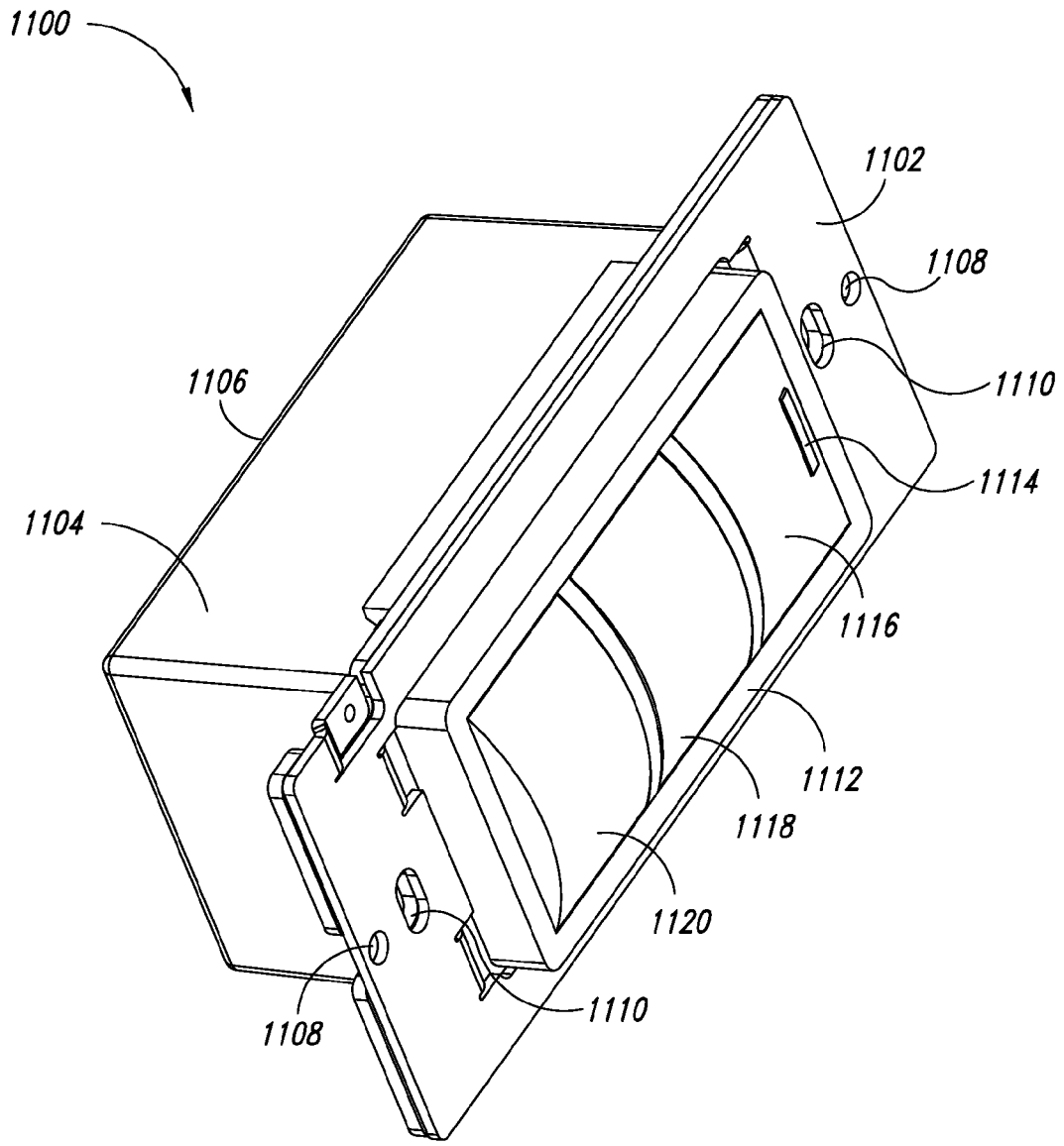
FIGS. 11A-11C illustrate isometric, front, and side views, respectively, of a switch controller in accordance with one aspect of the present disclosure.
Figure 11C:
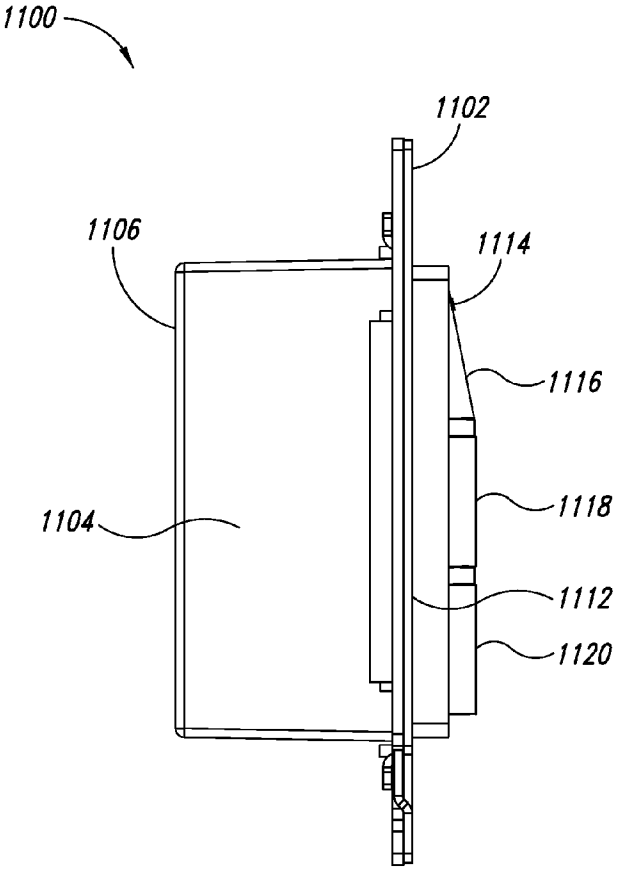
Figure 11B:
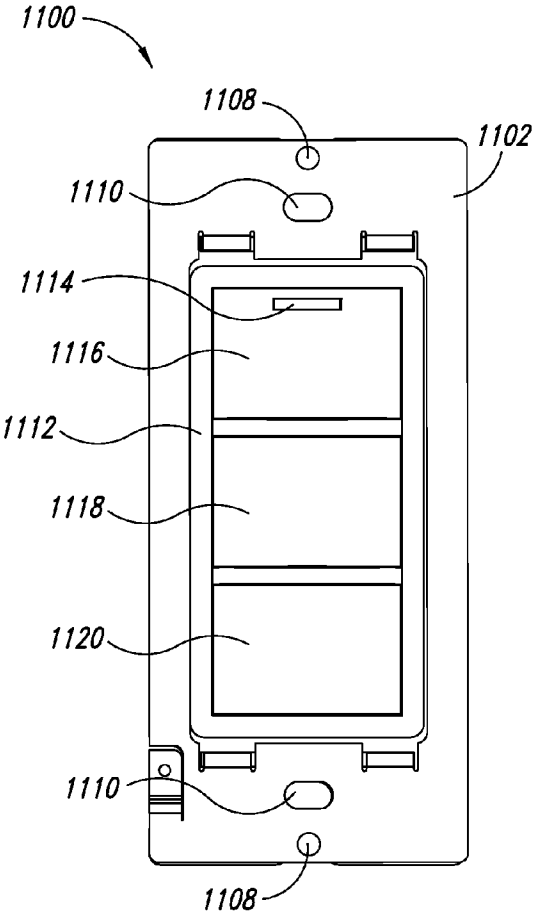

FIGS. 11A-11C illustrate isometric, front and side views, respectively, of the switch controller 1100 for mounting in a conventional switch box 12 (shown in FIG. 3). The switch controller 1100 includes a mounting bracket 1102 and a rear housing 1104. The rear housing 1104 includes at least one opening through a surface such as a rear surface 1106 of the rear housing 1104 for electrical wiring to pass therethrough. The rear housing 1104 is sized and shaped to be received in the conventional switch box 12.

The mounting bracket 1102 includes a pair of threaded screw holes 1108 and a pair of elongated openings 1110. After the rear housing 1104 has been received by the conventional switch box 12, the elongated openings 1106 are aligned with threaded holes 17. Two screws (not shown) extend through the elongated openings 1110 and through the threaded holes 17 to mount the switch controller 1100 to the switch box 12.

A face plate (not shown) may be coupled to the switch controller 1100 after the switch controller 1100 is mounted in the box 12 (FIG. 3). A pair of screws (not shown), which extend from the face plate, are passed through the threaded screw holes 1108 to couple the face plate to the switch controller 1100.

The switch controller 1100 includes, on a front side 1112, an indicator light 1114 positioned in an RF window 1116. The RF window 1116 is comprised of an RF transmissive material such that wireless communications 1010 (FIG. 10) may pass therethrough. An RF device (not shown) is disposed in the switch controller 1000 to receive the wireless communications 1010. In some embodiments, the RF device may also emit the wireless communications 1010. Such RF devices are well known to those skilled in the art and will not be described in detail herein.

Below the RF window 1116 is a first switch 1118 used to manually turn the fan on and below the first switch 1118 is a second switch 1120 used to manually turn the fan off. These components are affixed to a mounting board that includes the electrical circuitry for controlling operation of the fan. Other configurations are possible. For example, for a fan-only configuration the top button is on and the bottom button is off. For a fan and lamp combination, the top button toggles the lamp on and off, and the bottom button toggles the fan on and off. Firmware is provided that selects the function based on the components seen on the control board.

Figure 12A:
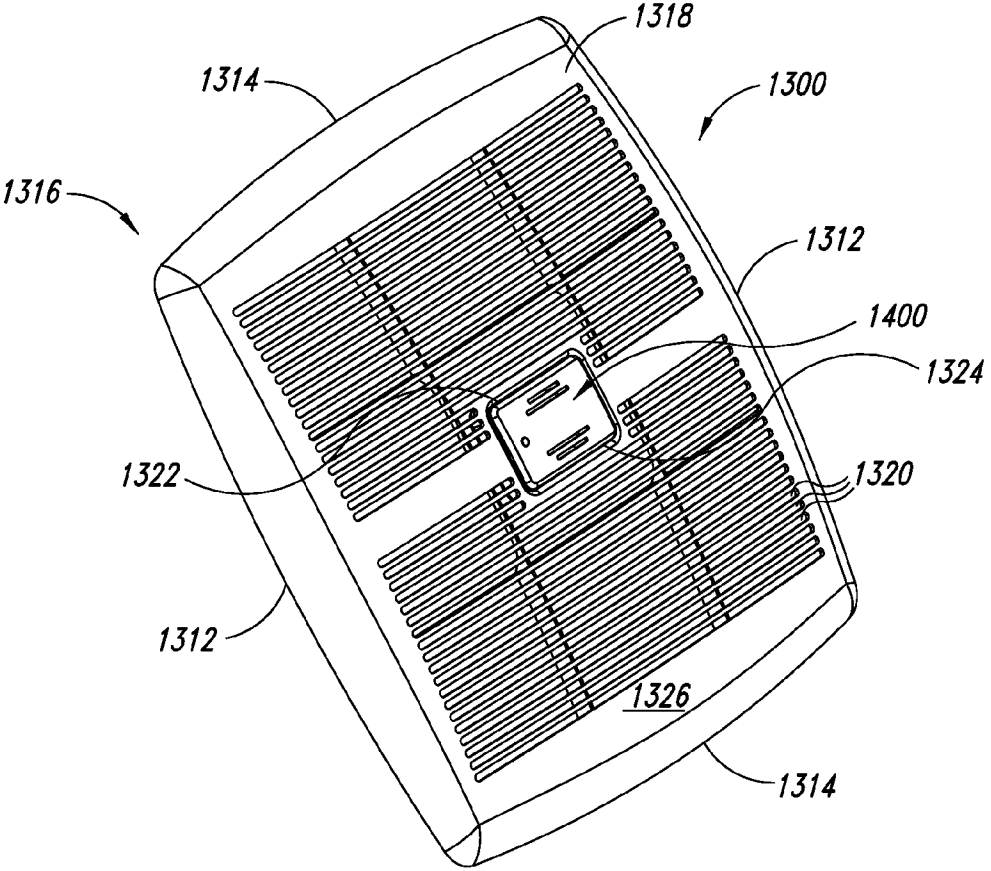
FIGS. 12A-12C illustrate isometric, front, and rear views, respectively, of a fan grill assembly in accordance with one aspect of the present disclosure.
Figure 12B:
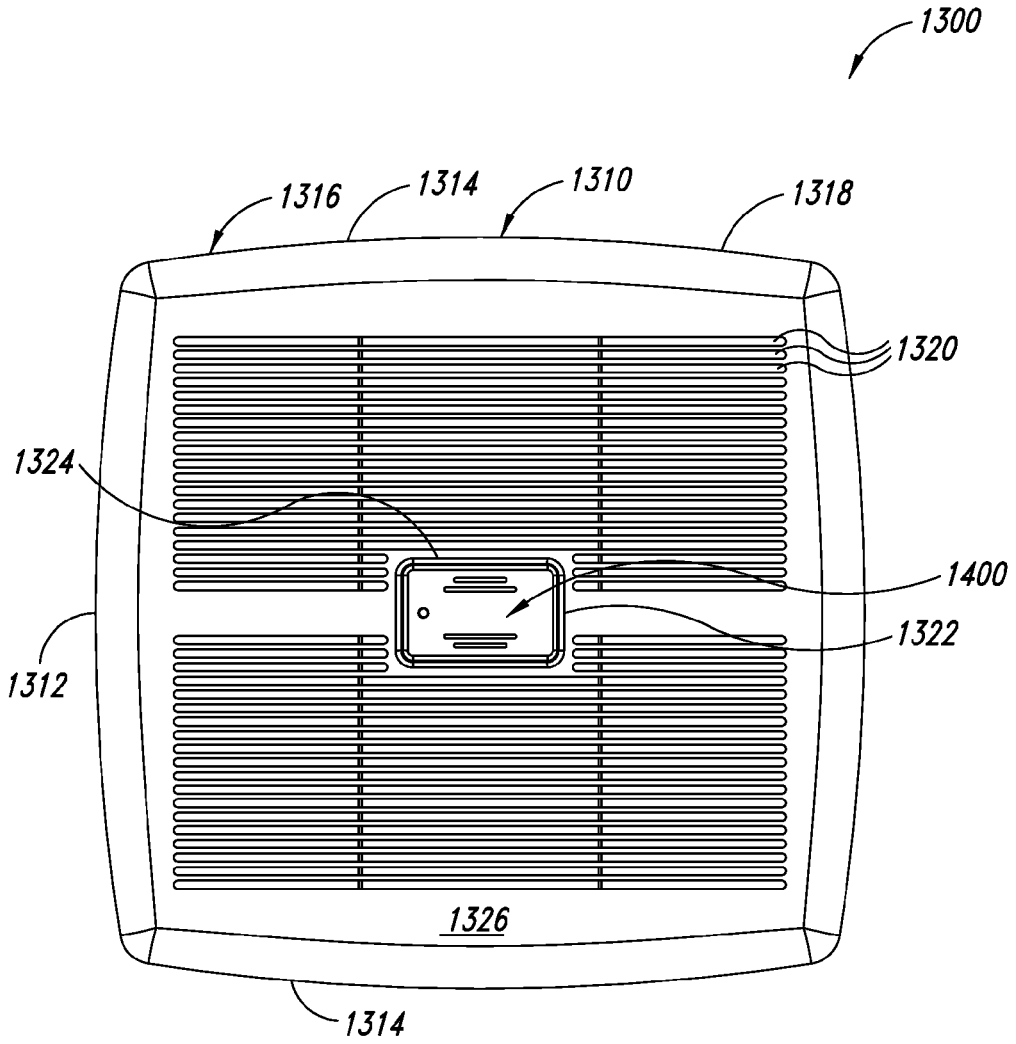
Figure 12C:
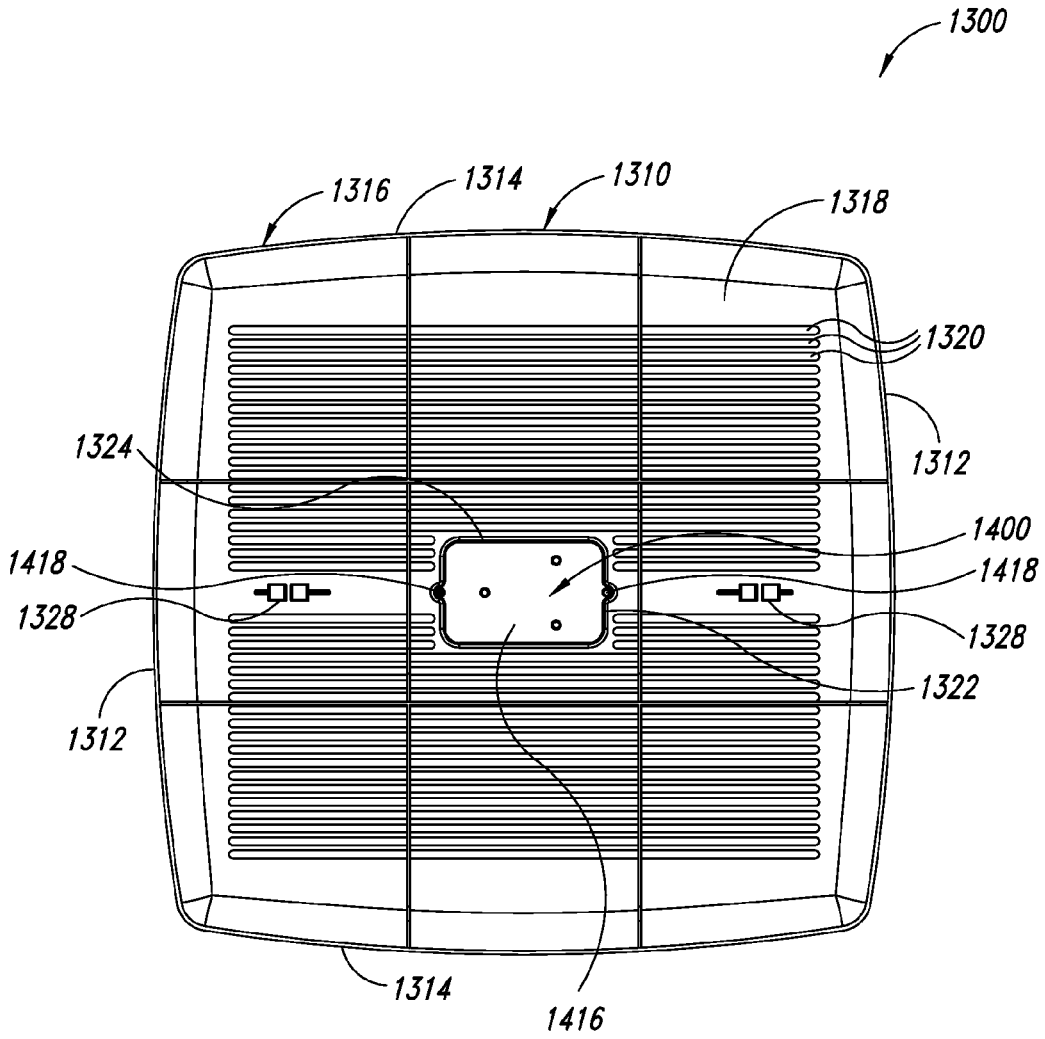
Figure 13A:
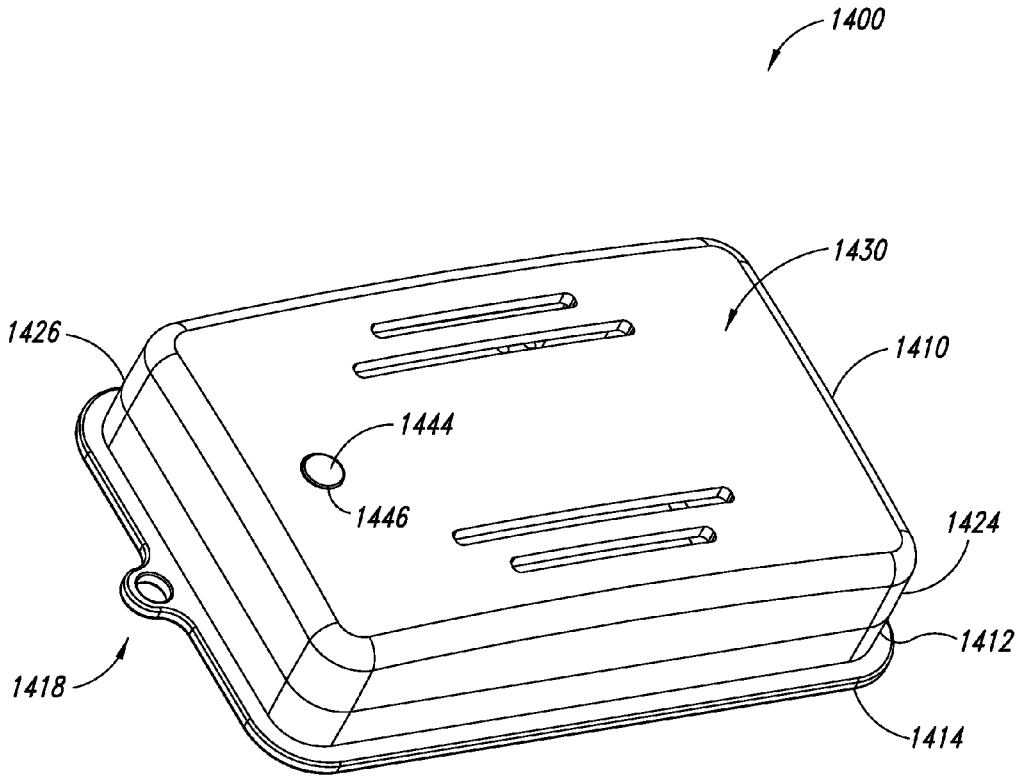
FIGS. 13A-13D illustrate isometric, side, rear, and exploded views, respectively of an atmospheric environment sensor assembly in accordance with one aspect of the present disclosure.
Figure 13C:
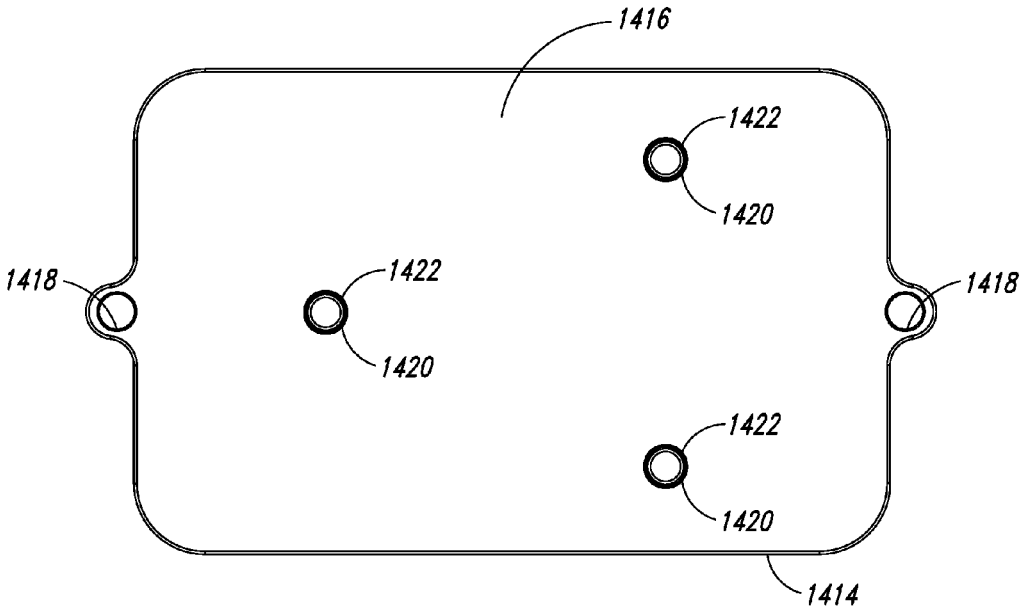
Figure 13B:
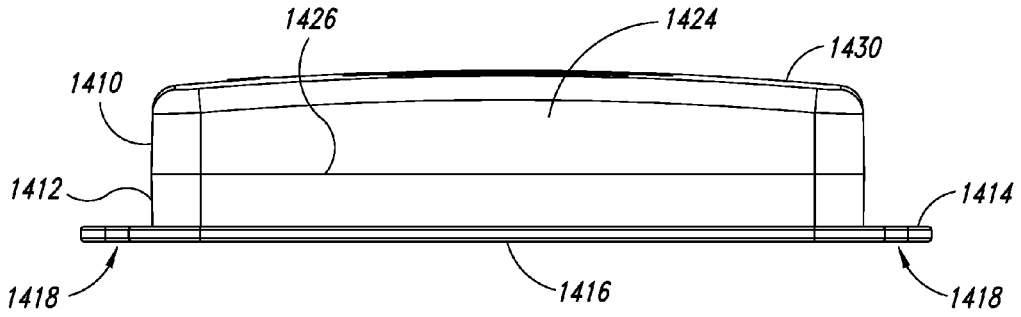
Figure 13D:
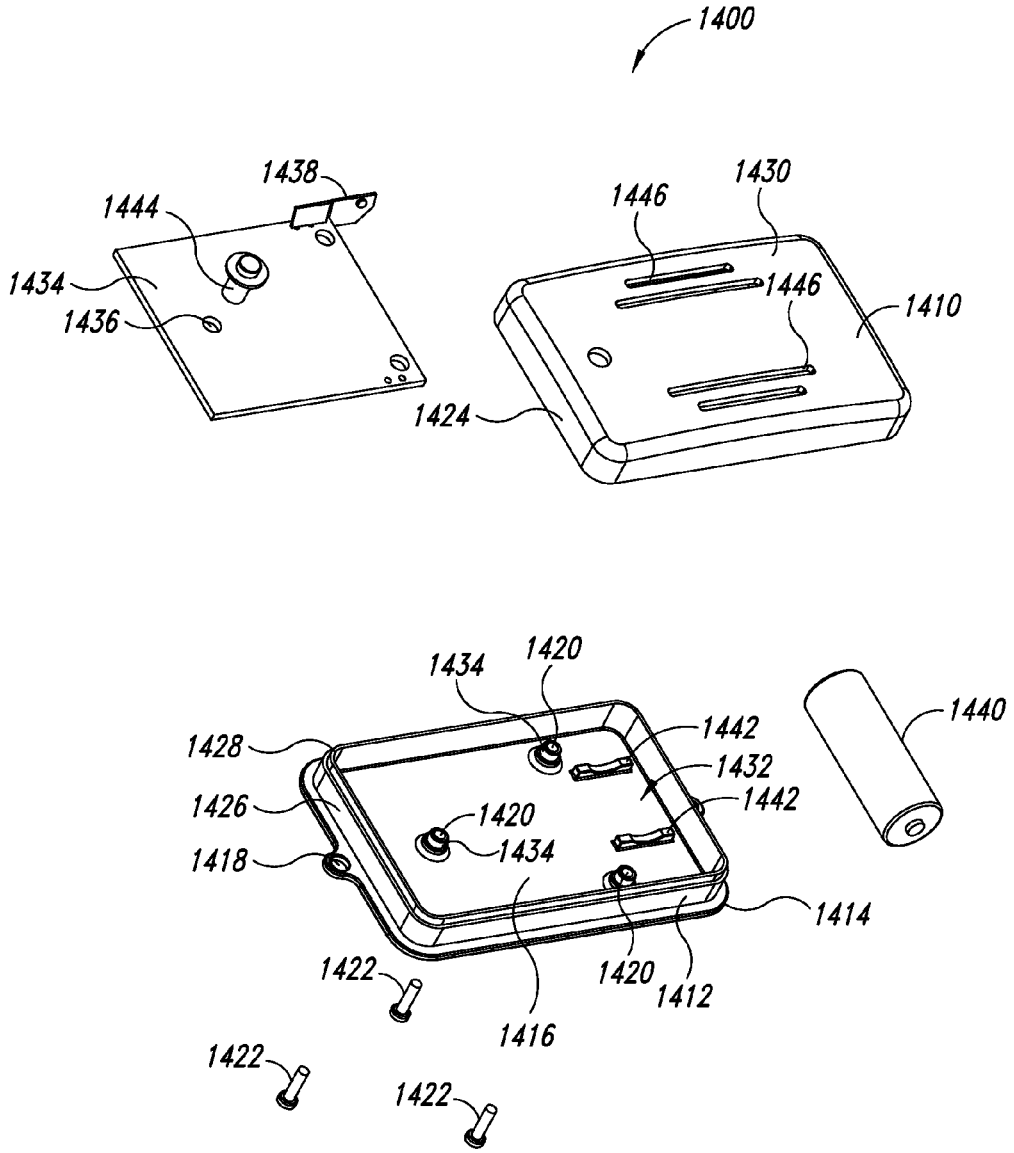

FIGS. 12A-12C show an isometric view, front view, and rear view of the fan grill assembly 1300, respectively. The fan grill assembly 1300 includes a grill 1310 and an atmospheric environment sensor assembly 1400 coupled to the grill 1310.

The grill 1310 is generally rectangular in shape with a pair of generally matching lateral sides 1312 that extend between a pair of generally matching transverse ends 1314. The lateral sides 1312 and the ends 1314 generally define a frame 1316. The grill 1310 also includes a grill cover 1318, which is circumscribed by the frame 1316. The grill cover 1318 includes conventional features such as air passage openings 1320 through which air passes. The grill cover 1318 also includes a generally rectangular shaped opening 1322.

The opening 1322 is defined by walls 1324. The walls 1324 extend from a front side 1326 of the grill cover 1318 to a rear side of the grill cover 1318. The rear side 1318 includes grill mounting members 1324. The grill mounting members 1328 are configured to removably couple to corresponding members to hold the grill 1310 in place.

FIGS. 13A-13D show an isometric view, side view, rear view, and exploded isometric view of the atmospheric environment sensor assembly 1400, respectively.

The atmospheric environment sensor assembly 1400 includes a front housing member 1410 and a rear housing member 1412. The rear housing member 1412 includes a flange 1414 that extends outward around a plate 1416. The flange 1414 includes a pair of screw holes 1418. The plate 1416 includes three screw holes 1420 that receive screws 1422.

The front housing member 1410 includes screw holes (not shown) aligned with the three screw holes 1420 of the plate 1416. The set of screw holes of the front housing member 1410 extend at least partially through a mounting structure (not shown) of the front housing member 1410 and may be threaded. The screws 1422 pass through the screw holes 1420 of the plate 1416 and are at least partially received by the screw holes of the front housing member 1410 to couple the front housing member 1410 and the rear housing member 1412 together.

The front housing member 1410 and the rear housing member 1412 include side walls 1424, 1426, respectively. The side wall 1426 includes a flange 1428. The side walls 1424, 1426 extend from a cover 1430 and the plate 1416, respectively. The side walls 1424, 1426 define a generally hollow interior 1432. The side wall 1424 is sized and shaped to receive the flange 1428.

The atmospheric environment sensor assembly 1400 further includes a circuit board 1434, which is sized and shaped to fit in the generally hollow interior 1432. The circuit board 1434 includes a set of holes 1436, which are sized to receive pegs 1434 having holes 1420 extending therethrough. The circuit board 1434 further includes battery electrodes 1438 (only one shown), which couple to a battery 1440. The battery is received by a battery holder 1442 and provides power to circuitry of the atmospheric environment sensor assembly 1400 including an LED (not shown). Circuitry of the atmospheric environment sensor assembly 1400 may include components to sense, among other things, temperature and humidity and may include RF components.

An optical post 1444 extends from the circuit board 1434 through a hole 1446 in the cover 1430. The optical post 1444 is comprised of a material through which light from an LED (not shown) is transmitted. Light emitted from the optical post 1444 indicates that the atmospheric environment sensor assembly 1400 is operational.

The cover 1430 defines a number of air passage openings 1446. Air is passed from outside of the atmospheric environment sensor assembly 1400 to the generally hollow interior 1432 so that the circuitry may sense, among other things, temperature and/or humidity. These air passages may be louvered to better conduct ambient air to the sensors. Ideally the relative humidity sensor is positioned opposite the openings 1446.

As noted on both FIGS. 8 and 9, switch S3 is populated only when a third switch is used. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

FIGS. 14A-M represent pseudo code associated with a further aspect of the present disclosure. Briefly, there are three approaches or "modes" of operation that can be adopted, implemented as either discrete control systems or a single system with three optional modes.

In a first mode of operation, the controller utilizes the sensed relative humidity data to control activation and deactivation of the ventilation system exhaust fan. For example, when the sensed relative humidity in the enclosed area reaches a threshold, the exhaust fan is activated by the controller until the relative humidity drops below the threshold. The fan would be activated after the threshold has been exceeded for a period of time, such as 4 seconds. Ideally, the fan will remain active for a set period of time after the sensed relative humidity falls below the threshold. The relative humidity threshold would be determined by local conditions and laws. For example, the threshold could be set at 75% on the west coast of North America.

In a second mode of operation, the controller operates in accordance with the description of FIGS. 1-13 above. For example, the fan would be activated when the humidity threshold is adjusted for temperature to give a local dew point, which is calculated (as previously described), and then the fan is activated when the threshold is exceeded for a determined period of time, such as four seconds.

In a third mode of operation, the controller operates based on a rate of change of the local relative humidity. In this technique the fan is activated when a history of the change of humidity is used to adjust the local dew point. The amount of adjustment is proportional to the rise-time in humidity observed over a set period of time, such as a 16 second period. For example, a four percent change in humidity over 16 seconds would result in the controller entering an activation sequence.

FIGS. 14A-M contain a listing of the pseudo code for a controller that implements all three modes as alternative modes, depending on the equipment or circuitry that is coupled to the controller that utilizes the software corresponding to the pseudo code. In other words, in accordance with one embodiment or aspect of the disclosure, the controller detects which hardware is coupled to it or is active, and the controller implements the appropriate mode of operation.

An important feature in all versions of the system is the use of bidirectional sensing at the sensor grid. In order to avoid polarizing of the grid elements, current flow is reversed periodically. This prevents a build up of charge or migration and resulting polarization of the sensor elements. Ideally, the polarity is changed every 100 milliseconds when the system is energized, although other periods may be used ranging from 75 ms to 250 ms or greater, depending on the implementation of the sensor and control circuitry.

Also, in this version the LED no longer remains on while power is available. Rather, the LED is on only when the fan is on, and the LED will flash dimly when both the fan is on and moisture has been sensed. In addition, a night light is provided as set forth in the code, which in this case could be the LED itself operating at full power.

As will be readily appreciated by those skilled in the art, the designs described above will find use in a variety of electronic applications, including without limitation power supplies for computers, computer processors, mobile communication devices, and the like.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

The invention claimed is:

1. A system to control ventilation of air in an enclosed area, comprising:

a ventilation device;

a first sensor adapted to detect the presence of moisture vapor in the air in the enclosed area;

a second sensor structured to detect air temperature in the enclosed area; and a circuit coupled to the ventilation device and to the first and second sensors and structured to determine a dew point value in the enclosed area and to control ventilation of the air in the enclosed area in response to the determination of the dew point value based on outputs of the first and second sensors, the circuit comprising a control circuit structured to activate the ventilation device in response to the determination of the dew point value, the control circuit structured to determine the dew point value in accordance with the following calculation:

$$RH=100-5(T-Td),$$

where:

RH=relative humidity

T=recorded temperature in Fahrenheit, and

Td is the dew point temperature in Fahrenheit, and the dew point value is the sum of RH and T (inverse), the control circuit further structured to activate the ventilation device when the dew point value is at or above a threshold count of 128 and to activate the ventilation device in one from among a plurality of modes of operation, comprising a first mode in which the control circuit is structured to activate the ventilation device in response to determination of the dew point value based on outputs of the first and second sensors, a second mode in which the control circuit is structured to activate the ventilation device based on the sensed amount of moisture vapor in the enclosed area over a threshold amount of moisture in the enclosed area, and a third mode in which the control circuit is structured to determine a rate of change of the sensed moisture over a period of time in the enclosed area and to activate the ventilation device when the rate of change over the period of time exceeds a threshold rate of change over the period of time.

2. The system of claim 1 wherein the control circuit is structured to activate a ventilation device before condensate forms in the enclosed area.

3. The system of claim 2 wherein the control circuit is structured to detect hardware coupled to the control circuit and to select the operating mode corresponding to the detected hardware.

4. The system of claim 2, wherein the threshold count of 128 is a combination of RH and the inverse of T less the value of 5 for a range of temperature T of about 50 degrees Fahrenheit to and including 112 degrees Fahrenheit.

5. The system of claim 4, wherein the control circuit is configured to detect hardware coupled to the control circuit and to select the operating mode corresponding to the detected hardware.

6. The system of claim 2 wherein the ventilation device comprises an exhaust fan structured to pull air from the enclosed area and exhaust it to the exterior and to draw fresh air into the enclosed area that has a lower moisture content than the air exhausted from the enclosed area.

7. The system of claim 2 wherein the control circuit includes a manual switch to enable manual control of the ventilation system.

8. A method for controlling a ventilation fan in an enclosed area, the method comprising:

detecting the presence of local moisture vapor in the enclosed area;

detecting local temperature in the enclosed area; and determining a dew point value in the enclosed area and controlling operation of the fan in response to the determined dew point value in accordance with the following calculation:

$$RH=100-5(T-Td),$$

where:

RH=relative humidity

T=recorded temperature in Fahrenheit, and

Td is the dew point temperature in Fahrenheit, and the dew point value is the sum of RH and T (inverse), activating the fan when the dew point value is at or above a threshold count of 128 by activating the fan in one from among a plurality of modes of operation, comprising a first mode of activating the fan in response to the determination of the dew point value based on outputs of first and second sensors, a second mode of activating the fan based on the sensed amount of moisture over a threshold amount of moisture in the enclosed area, and a third mode of determining a rate of change of the sensed moisture over a period of time in the enclosed area and activating the fan when the rate of change over the period of time exceeds a threshold rate of change over the period of time.

9. The method of claim 8, further comprising activating the ventilation device when the dew point value exceeds a threshold dew point value, checking repeatedly for the presence of moisture vapor, and activating the fan for a fixed duration of time when the moisture vapor has decreased below the threshold dew point value.

10. The method of claim 8, wherein the control circuit is configured to detect hardware coupled to the control circuit and to select the operating mode corresponding to the detected hardware.

* * * * *